US007578892B2

(12) United States Patent
Hirosawa et al.

(10) Patent No.: US 7,578,892 B2
(45) Date of Patent: Aug. 25, 2009

(54) MAGNETIC ALLOY MATERIAL AND METHOD OF MAKING THE MAGNETIC ALLOY MATERIAL

(75) Inventors: Satoshi Hirosawa, Shiga (JP); Hiroyuki Tomizawa, Osaka (JP); Ryosuke Kogure, Tochigi (JP)

(73) Assignee: Hitachi Metals, Ltd., Tokyo (JP)

( * ) Notice: Subject to any disclaimer, the term of this patent is extended or adjusted under 35 U.S.C. 154(b) by 236 days.

(21) Appl. No.: 11/278,004

(22) Filed: Mar. 30, 2006

(65) Prior Publication Data

US 2006/0231163 A1 Oct. 19, 2006

Related U.S. Application Data

(60) Provisional application No. 60/667,801, filed on Mar. 31, 2005.

(51) Int. Cl.
*H01F 1/055* (2006.01)
*H01F 1/08* (2006.01)

(52) U.S. Cl. ..... 148/101; 419/10; 419/38; 148/301; 75/230; 75/246

(58) Field of Classification Search ..... None
See application file for complete search history.

(56) References Cited

U.S. PATENT DOCUMENTS

| | | | |
|---|---|---|---|
| 6,826,915 | B2 | 12/2004 | Wada et al. |
| 2004/0079446 | A1 | 4/2004 | Kogure et al. |
| 2004/0231338 | A1 | 11/2004 | Saito et al. |
| 2006/0076084 | A1* | 4/2006 | Nakajima ..... 148/101 |

FOREIGN PATENT DOCUMENTS

| | | |
|---|---|---|
| JP | 01-276705 A | 11/1989 |
| JP | 02-220412 A | 9/1990 |
| JP | 2000-54086 | 2/2000 |
| JP | 2000-054086 A | 2/2000 |
| JP | 2002-69596 | 3/2002 |
| JP | 2002-069596 A | 3/2002 |

(Continued)

OTHER PUBLICATIONS

Liu, X.B. "The Structure and large magnetocaloric effect in rapidly quenched LaFe11.4Si1.6 compound." Journal of Physics: Condensed Matter, vol. 16, 2004, pp. 8043-8051.

(Continued)

*Primary Examiner*—John P. Sheehan
(74) *Attorney, Agent, or Firm*—Keating & Bennett, LLP

(57) ABSTRACT

A magnetic alloy material according to the present invention has a composition represented by $Fe_{100-a-b-c}RE_aA_bCo_c$, where RE is a rare-earth element always including La, A is either Si or Al, 6 at %≦a≦11 at %, 8 at %≦b≦18 at %, and 0 at %≦c≦9 at %, and has either a two phase structure consisting essentially of an α-Fe phase and an (RE, Fe, A) phase including 30 at % to 90 at % of RE or a three phase structure consisting essentially of the α-Fe phase, the (RE, Fe, A) phase including 30 at % to 90 at % of RE and an RE(Fe, A)$_{13}$ compound phase with an $NaZn_{13}$-type crystal structure. The respective phases have an average minor-axis size of 40 nm to 2 μm.

14 Claims, 26 Drawing Sheets

FOREIGN PATENT DOCUMENTS

| | | | |
|---|---|---|---|
| JP | 2003-193209 | A | 7/2003 |
| JP | 2004-100043 | | 4/2004 |
| JP | 3630164 | B2 | 12/2004 |
| JP | 2005-36302 | | 2/2005 |
| JP | 2005-200749 | A | 7/2005 |
| WO | 2004/038055 | A1 | 5/2004 |

OTHER PUBLICATIONS

Official Communication cited in corresponding UK Patent Application GB 0606428.1, mailed Aug. 3, 2006.

* cited by examiner (a)

(b)

(a)

(b)

(c)

MAGNETIC ALLOY MATERIAL AND METHOD OF MAKING THE MAGNETIC ALLOY MATERIAL

CROSS-REFERENCE TO RELATED PATENT APPLICATIONS

This application claims the benefit of U.S. Provisional Application No. 60/667,801 filed Mar. 31, 2005, which is incorporated by reference.

BACKGROUND OF THE INVENTION

1. Field of the Invention

The present invention relates to a magnetic alloy material that can be used effectively as a magnetic refrigerant material or a magnetostrictive material and also relates to a method of making such a magnetic alloy material.

2. Description of the Related Art

A magnetic alloy, having a composition represented by the general formula: $La_{1-z}RE_z(Fe_{1-x}A_{x-y}TM_y)_{13}$ (where A is at least one element that is selected from the group consisting of Al, Si, Ga, Ge and Sn; TM is at least one of the transition metal elements; RE is at least one of the rare-earth elements except La; and the mole fractions x, y and z satisfy $0.05 \leqq x \leqq 0.2$, $0 \leqq y \leqq 0.1$ and $0 \leqq z \leqq 0.1$, respectively, and which will be referred to herein as an "La(Fe, Si)$_{13}$ based magnetic alloy") has an $NaZn_{13}$-type crystal structure and exhibits giant magnetocaloric effect and magnetovolume effect at temperatures around its Curie temperature Tc. The La(Fe, Si)$_{13}$ based magnetic alloy is recently expected to be applicable for use as a magnetic refrigerant material or as a magnetostrictive material (see Patent Documents Nos. 1 and 2, for example).

In the prior art, the La(Fe, Si)$_{13}$ based magnetic alloy is produced by thermally treating a mold-cast alloy, obtained by an arc melting or high frequency melting process, at 1,050° C. for approximately 168 hours within a vacuum, which results in very low productivity.

The applicant of the present application disclosed a method of making an La(Fe, Si)$_{13}$ based magnetic alloy material highly efficiently by a melt-quenching process (which will also be referred to herein as an "rapid solidification process") in Patent Document No. 3. However, if the magnetic alloy material disclosed in Patent Document No. 3 is used as a magnetic refrigerant material, then the magnetic refrigerant material should have its area of thermal contact with a heat transfer fluid increased by using an alloy material prepared by coarsely pulverizing a ribbon alloy material. The heat transfer fluid is preferably a liquid fluid including an aqueous antifreeze agent, having a relatively high specific heat and exhibiting good fluidity at its operating temperature, and a hydrocarbon based solvent with a low freezing point. And as the magnetic refrigerant material, a bed obtained by storing a coarse powder of an alloy material into a basket type container, a powder compact that has been compressed and compacted into thin plate shapes, and a sintered body that has been sintered into a porous bulk shape such that a liquid can pass through the body may be used.

Meanwhile, a method of making an La(Fe, Si)$_{13}$ based magnetic alloy sintered body in a desired shape by a powder metallurgical process is described in Patent Document No. 4. In a powder metallurgical process, a sintered body is obtained by sintering a compact (i.e., a powder compact) that has been formed by pressing and compacting an alloy powder (fine powder). Thus, the powder metallurgical process needs an increased number of manufacturing process steps but realizes a broader variety of shapes with increased freedom. As a result, the processing cost can be rather reduced.

Patent Document No. 1: Japanese Patent Application Laid-Open Publication No. 2000-54086, Patent Document No. 2: Japanese Patent Application Laid-Open Publication No. 2002-69596, Patent Document No. 3: Japanese Patent Application Laid-Open Publication No. 2004-100043 and Patent Document No. 4: Japanese Patent Application Laid-Open Publication No. 2005-36302

The present inventors attempted to apply a powder metallurgical process to processing an La(Fe, Si)$_{13}$ based magnetic alloy material. As a result, we faced the following problems.

Specifically, to apply a powder metallurgical process to the La(Fe, Si)$_{13}$ based magnetic alloy material disclosed in Patent Document No. 3, the target $NaZn_{13}$-type compound phase needs to be produced by a heat treatment process, finely pulverized, and then a compact needs to be made of the resultant powder and sintered. That is to say, if the manufacturing process described in Patent Document No. 3 is adopted, then the overall heat treatment time can be shortened significantly. However, the heat treatment processes need to be carried out twice in a vacuum to produce the $NaZn_{13}$-type compound phase and to sinter the compact, respectively, which should result in low productivity.

In addition, according to the method disclosed in Patent Document No. 3, the $NaZn_{13}$-type compound phase can also be produced by a solid-phase reaction that is based on the element diffusion process in a ribbon of the as-spun alloy (i.e., rapidly solidified alloy). That is why even if the rapidly solidified alloy ribbon includes relatively coarse structures, the $NaZn_{13}$-type compound phase can also be produced by thermally treating the rapidly solidified alloy ribbon. Nevertheless, if a powder metallurgical process is applied to such a rapidly solidified alloy including coarse structures, then the respective phases that form the structures may either be separate particles or have significantly different compositions between the particles. In that case, to produce the target phase, the element needs to transfer between the powder particles, thus requiring long hours of sintering (i.e., a type of heat treatment process), which is practically undesirable.

Additionally, in the as-spun state, it is usually very difficult to finely pulverize a structure in which Fe has grown into dendritic primary crystals with excessively large sizes. That is why even by adopting the rapid solidification process, if the size of the primary crystals of Fe is larger than a particle size (of 2 μm) required by the powder metallurgical process, it is extremely difficult to make a powder with the target particle size.

The alloy material described in Patent Document No. 4 does not have a sufficiently fine structure, either, because the alloy material is prepared at a low quenching rate of $1\times10^{4}$° C./s. Consequently, to make a sintered body consisting essentially of the $NaZn_{13}$-type compound phase, (1) the proportion of the $NaZn_{13}$-type compound phase to the overall material alloy needs to be increased to at least 85 mass % in advance by thermally treating the material alloy, (2) the sintering process should be carried out for long hours and (3) at as high a temperature as at least 1,280° C. and other problems arise.

If the material alloy has not been quenched so much (e.g., an ingot alloy), various problems also arise in the sintering process. Specifically, it is virtually impossible to eliminate the α -Fe phase at a sintering temperature that is lower than the peritectic point. At a temperature that is equal to or higher than the peritectic point, on the other hand, α -Fe phase, LaFeSi compound phase and other phases are newly produced. For these reasons, to make a single-phase, high-density sintered body, the sintering process needs to be carried out at an elevated temperature, precisely controlled within a narrow range, and for long hours.

In order to overcome the problems described above, a primary object of the present invention is to provide a method of making a sintered body, including an $NaZn_{13}$-type compound phase, by a relatively cost-effective powder metallurgical process, which requires only a short sintering process time, and also provide a material alloy (powder) for use in the manufacturing process.

SUMMARY OF THE INVENTION

A magnetic alloy material according to the present invention has a composition represented by the general formula: $Fe_{100-a-b-c}RE_aA_bCo_c$, where RE is a rare-earth element that always includes La, A is either Si or Al, 6 at %≦a≦11 at %, 8 at %≦b≦18 at %, and 0 at %≦c≦9 at %, and has either a two phase structure consisting essentially of an α -Fe phase and an (RE, Fe, A) phase including 30 at % to 90 at % of RE or a three phase structure consisting essentially of the α -Fe phase, the (RE, Fe, A) phase including 30 at % to 90 at % of RE and an $RE(Fe, A)_{13}$ compound phase with an $NaZn_{13}$-type crystal structure. The respective phases have an average minor-axis size of 40 nm to 2 μm. The magnetic alloy material of the present invention is an as-spun alloy (i.e., a rapidly solidified alloy that has not been thermally treated yet) prepared by a melt-quenching process (such as a strip casting process or a melt spinning process).

In one preferred embodiment, the mole fraction a in the general formula is from 7 at % to 9 at %.

In another preferred embodiment, the (RE, Fe, A) phase is an REFeSi compound phase.

In still another preferred embodiment, Co substitutes for Fe in at least one of the α -Fe phase, the (RE, Fe, A) phase and the $RE(Fe, A)_{13}$ compound phase.

In yet another preferred embodiment, the magnetic alloy material has an oxygen concentration of 0.07 at % to 0.18 at %.

In yet another preferred embodiment, the magnetic alloy material is changeable into the $RE(Fe, A)_{13}$ compound phase almost entirely by being thermally treated at temperature of 600° C. or more for at least 10 seconds.

In yet another preferred embodiment, the magnetic alloy material is in the form of powder, of which the particles have minor-axis sizes of 2 μm to 200 μm.

In yet another preferred embodiment, particles of the powder have a minor-axis size of less than 10 μm.

A method of making a magnetic alloy material according to the present invention includes the steps of: preparing a melt of an alloy material having a predetermined composition; and rapidly quenching and solidifying the melt of the alloy material such that an average quenching rate is $2\times10^{4\circ}$ C./s to $2\times10^{6\circ}$ C./s within the temperature range of 1,500° C. to 600° C., thereby obtaining a rapidly solidified alloy having a composition represented by the general formula: $Fe_{100-a-b-c}RE_aA_bCo_c$, where RE is a rare-earth element that always includes La, A is either Si or Al, 6 at %≦a≦11 at %, 8 at %≦b≦18 at %, and 0 at %≦c≦9 at %, and having either a two phase structure consisting essentially of an α -Fe phase and an (RE, Fe, A) phase including 30 at % to 90 at % of RE or a three phase structure consisting essentially of the α -Fe phase, the (RE, Fe, A) phase including 30 at % to 90 at % of RE and an $RE(Fe, A)_{13}$ compound phase with an $NaZn_{13}$-type crystal structure. The respective phases have an average minor-axis size of 40 nm to 2 μm.

In one preferred embodiment, the mole fraction a in the general formula is from 7 at % to 9 at %.

In another preferred embodiment, the (RE, Fe, A) phase is an REFeSi compound phase.

In still another preferred embodiment, Co substitutes for Fe in at least one of the α -Fe phase, the (RE, Fe, A) phase and the $RE(Fe, A)_{13}$ compound phase.

In yet another preferred embodiment, the rapidly solidified alloy has a thickness of 2 μm to 200 μm.

In yet another preferred embodiment, the step of obtaining the rapidly solidified alloy includes setting the teeming temperature of the alloy material higher than the liquidus temperature of the alloy material by 50° C. to 150° C.

In yet another preferred embodiment, the step of obtaining the rapidly solidified alloy includes controlling the roller peripheral velocity of a chill roller within the range of 3 m/s to 30 m/s.

In yet another preferred embodiment, the method further includes the step of pulverizing the rapidly solidified alloy, thereby making a powder, of which the particles have minor-axis sizes of 2 μm to 200 μm.

In yet another preferred embodiment, particles of the powder have a minor-axis size of less than 10 μm.

A method of making a sintered body of a magnetic alloy according to the present invention includes the steps of: making the powder by the method described above; compacting the powder to make a compact; and sintering the compact.

In one preferred embodiment, the step of sintering includes sintering the compact within the temperature range of 600° C. to less than 1,320° C. In a specific preferred embodiment, the sintering temperature is 900° C. and above.

In another preferred embodiment, the step of sintering includes sintering the compact within the temperature range for ten seconds to eight hours, more preferably four hours or less.

In the La(Fe, Si) based magnetic alloy of the present invention, the respective constituent phases thereof have an average minor-axis size of 40 nm to 2 μm. Thus, when a powder metallurgical process is adopted, there is no need to diffuse the elements between particles in the sintering process and the target $La(Fe, Si)_{13}$ based $NaZn_{13}$-type compound phase can be obtained in a short time. That is to say, according to the present invention, the $La(Fe, Si)_{13}$ based $NaZn_{13}$-type compound phase can be obtained by performing a heat treatment only once as a sintering process by a powder metallurgical technique.

In addition, the magnetic alloy of the present invention can be easily pulverized in the as-spun state (i.e., as a rapidly solidified alloy). The alloy powder, obtained by pulverizing the magnetic alloy, has a relatively low oxygen concentration. And the La(Fe, Si) based magnetic alloy (sintered body), obtained by sintering (i.e., thermally treating) a compact of the material powder, has a relatively low oxygen concentration, also. Consequently, the magnetic properties of the $La(Fe, Si)_{13}$-type compound, obtained by pulverizing, compacting and then sintering the as-spun alloy, are at least comparable to the conventional ones and the compound can be used effectively as a magnetic refrigerant material or a magnetostrictive material.

Figure 9:
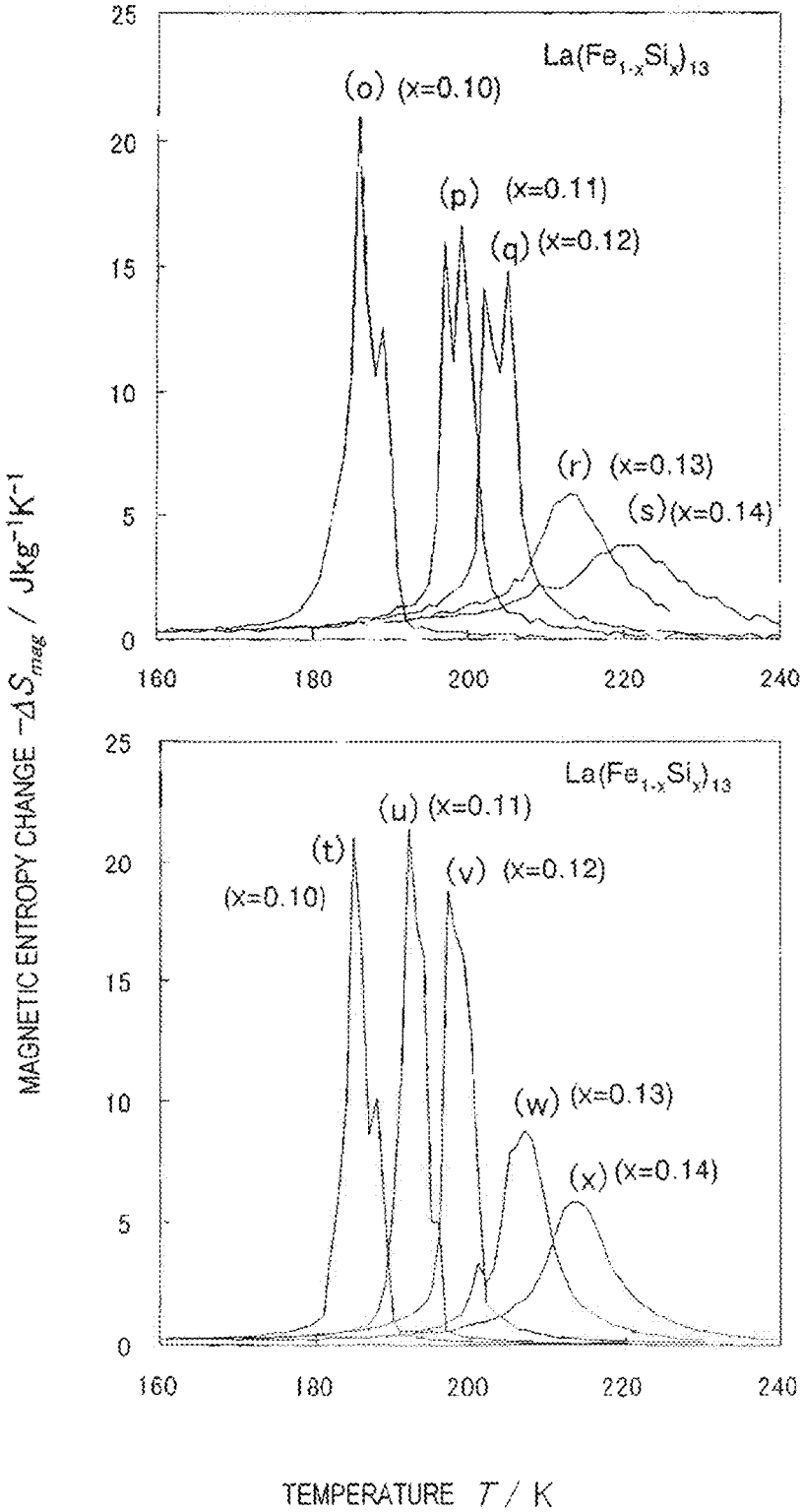

The upper portion of FIG. 9 is a graph showing the temperature dependences of $-\Delta S_{mag}$ for Samples (O), (p), (q), (r) and (s) that were made of alloy ribbons, while the lower portion of FIG. 9 is a graph showing the temperature dependences of $-\Delta S_{mag}$ for Samples (t), (u), (v), (w) and (x) that were made of cast alloys.

Figure 10:
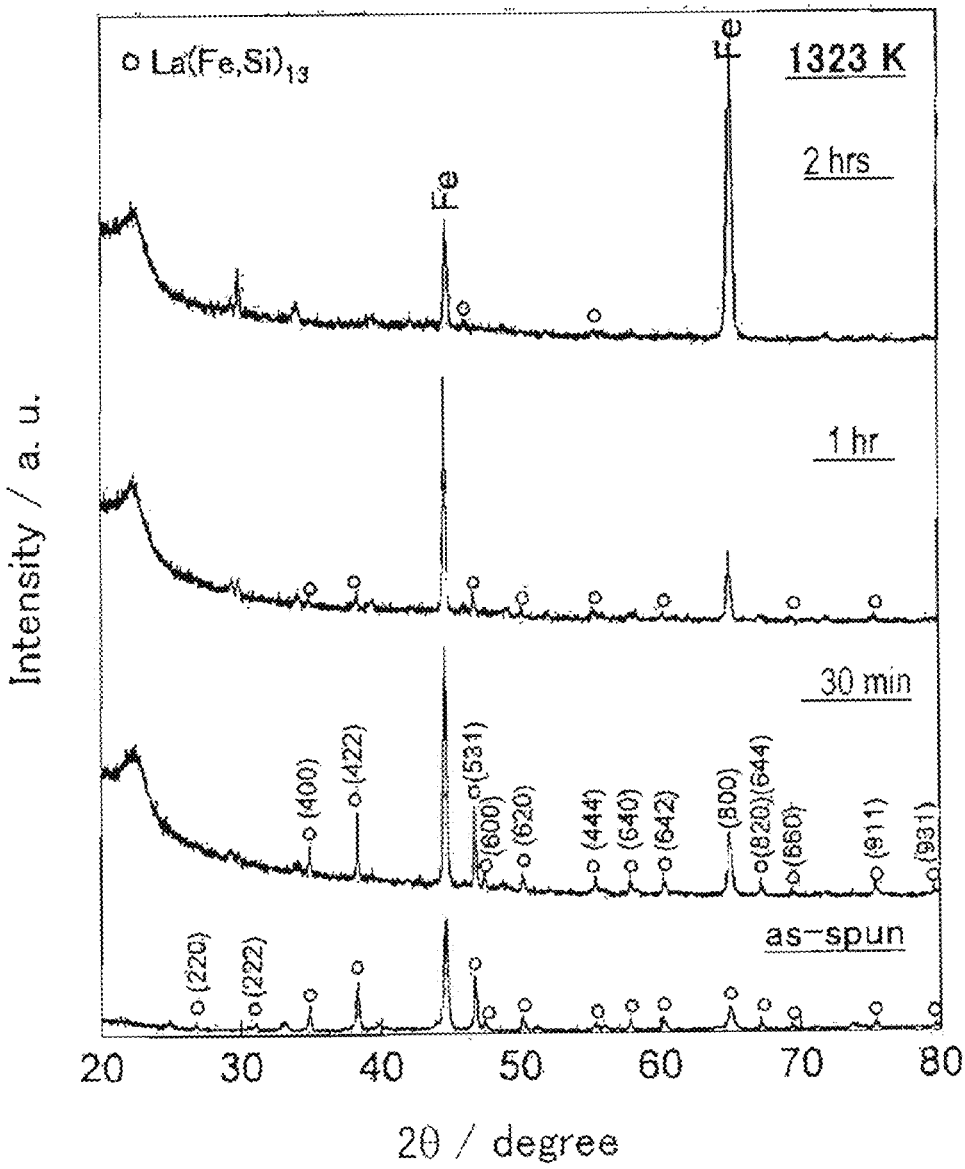

FIG. 10 shows the results of an XRD analysis carried out on the surface of ribbons that had been thermally treated for respective amounts of time.

Figure 11:
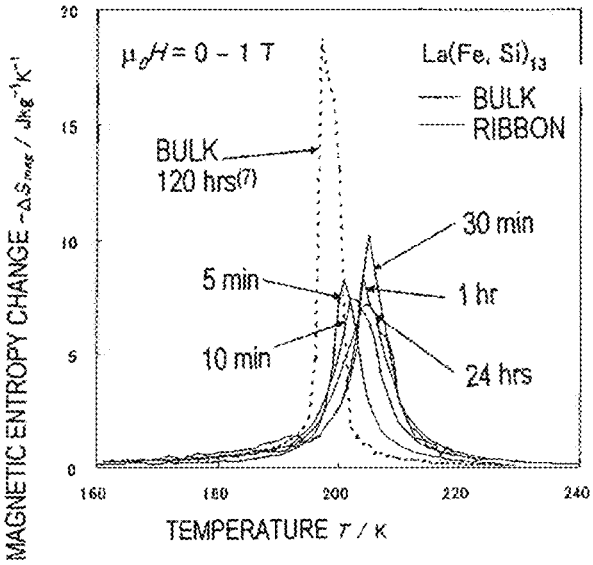

FIG. 11 is a graph showing $-\Delta S_{mag}$ of as-spun ribbons, which had been made at a roller peripheral velocity $V_s$ of 20 m/s and then thermally treated for 5 minutes, 10 minutes, 30 minutes, 1 hour and 24 hours, respectively.

Figure 12:
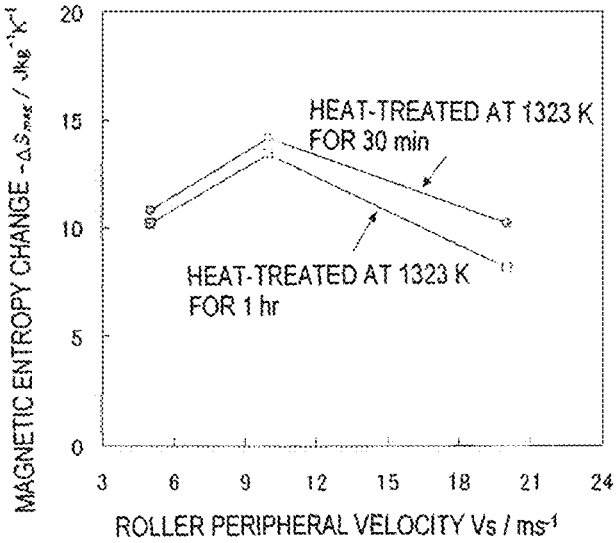

FIG. 12 is a graph showing how $-\Delta S_{mag}$ of a ribbon sample changed with the roller peripheral velocity.

Figure 13:
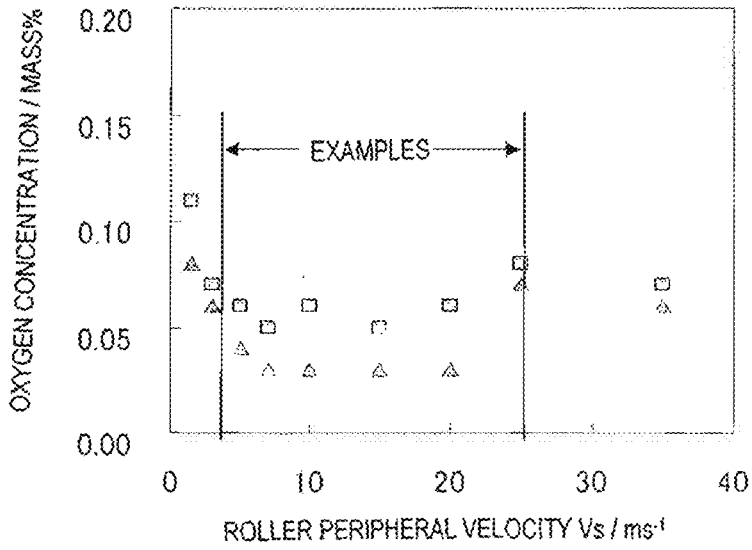

FIG. 13 shows how the oxygen concentration of an as-spun rapidly solidified alloy (of which the data are plotted with open triangles Δ) and the concentration of oxygen in a magnetic alloy, including the target phase and obtained by thermally treating the as-spun alloy (of which the data are plotted with open squares □), changed with the roller peripheral velocity.

Figure 14:
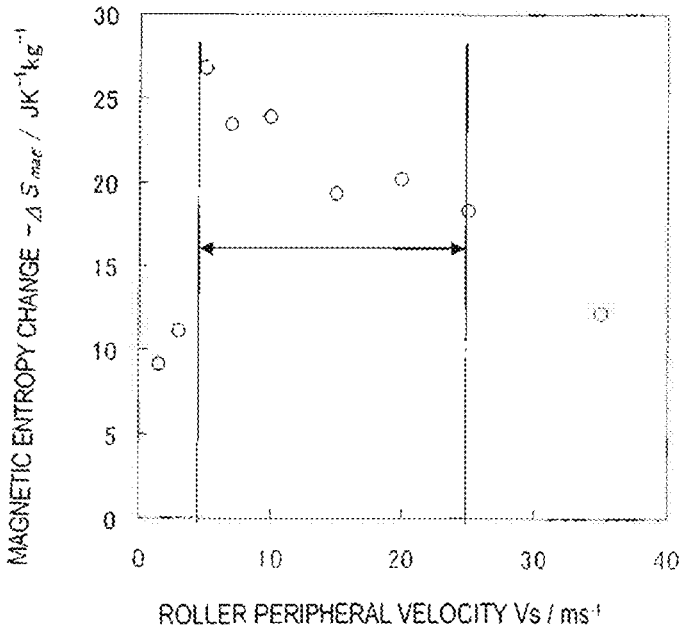

FIG. 14 is a graph showing the magnetic entropy change of the magnetic alloy shown in FIG. 13.

Figure 15:
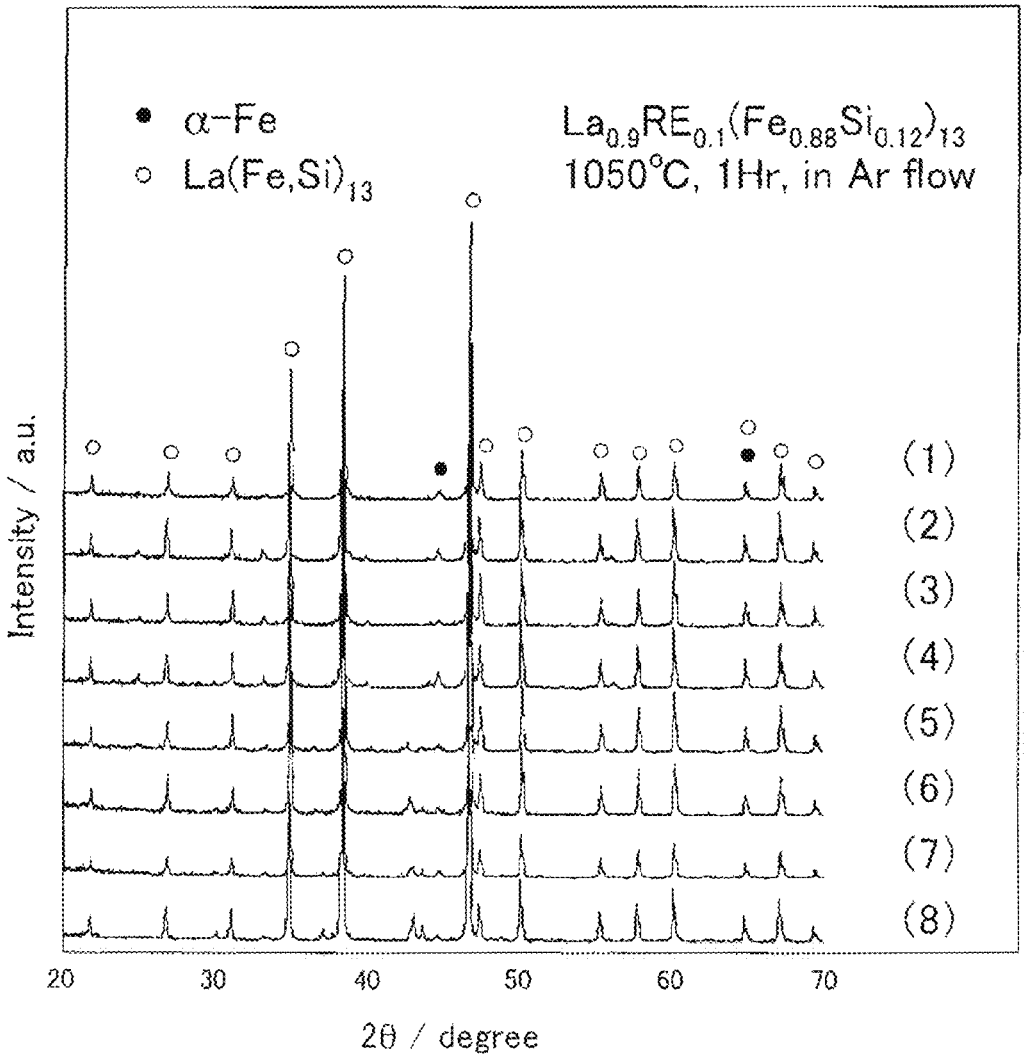

FIG. 15 shows the XRD data of an alloy including a non-La RE.

Figure 16:
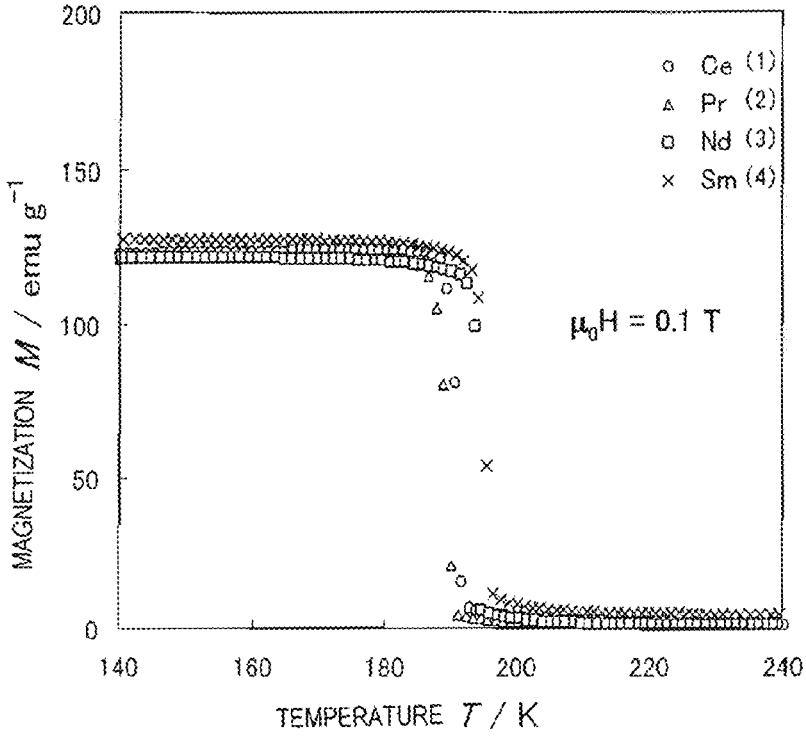

FIG. 16 is a graph showing the measuring data of the Curie temperature of an alloy including a non-La RE.

Figure 17:
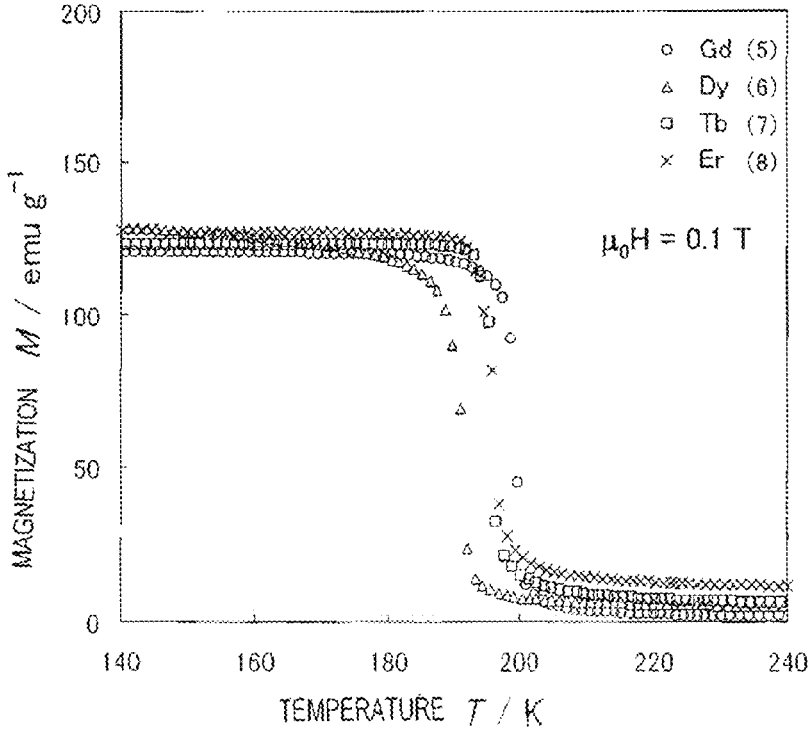

FIG. 17 is a graph showing the measuring data of the Curie temperature of another alloy including a non-La RE.

Figure 18:
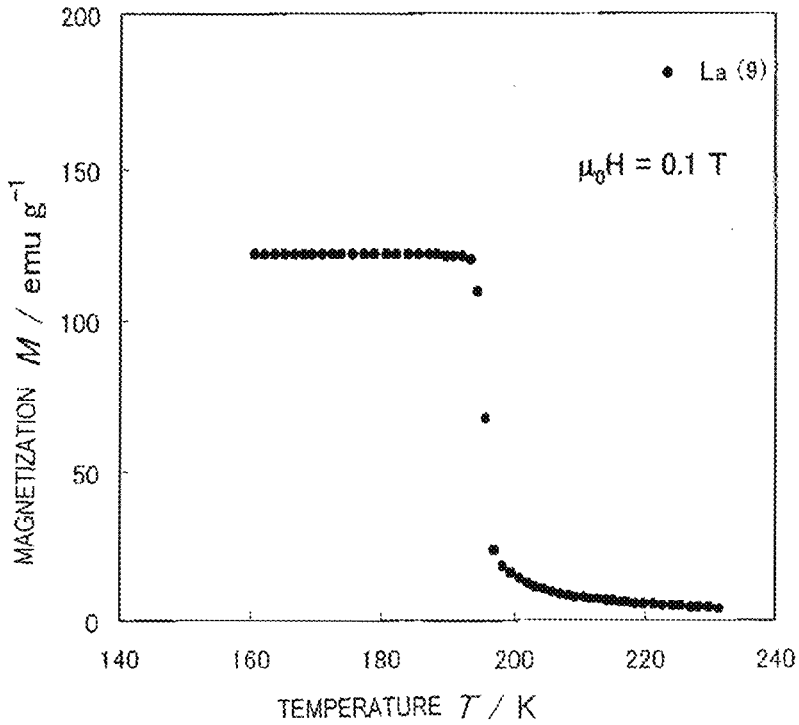

FIG. 18 is a graph showing the measuring data of the Curie temperature of an alloy including no non-La RE.

Figure 19:
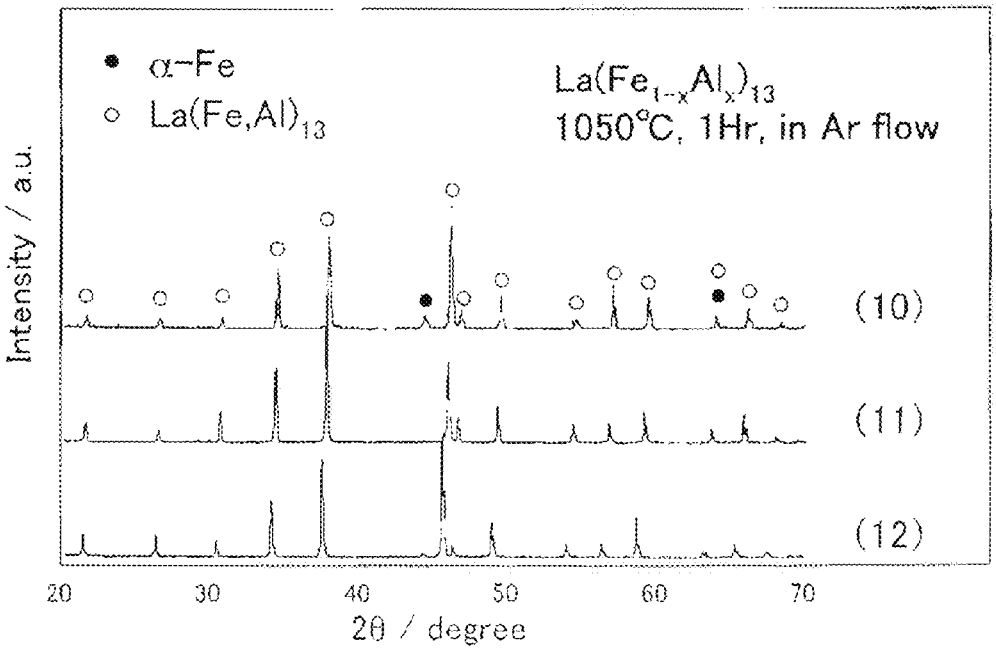

FIG. 19 shows the XRD data of a rapidly solidified alloy including Al.

Figure 20:
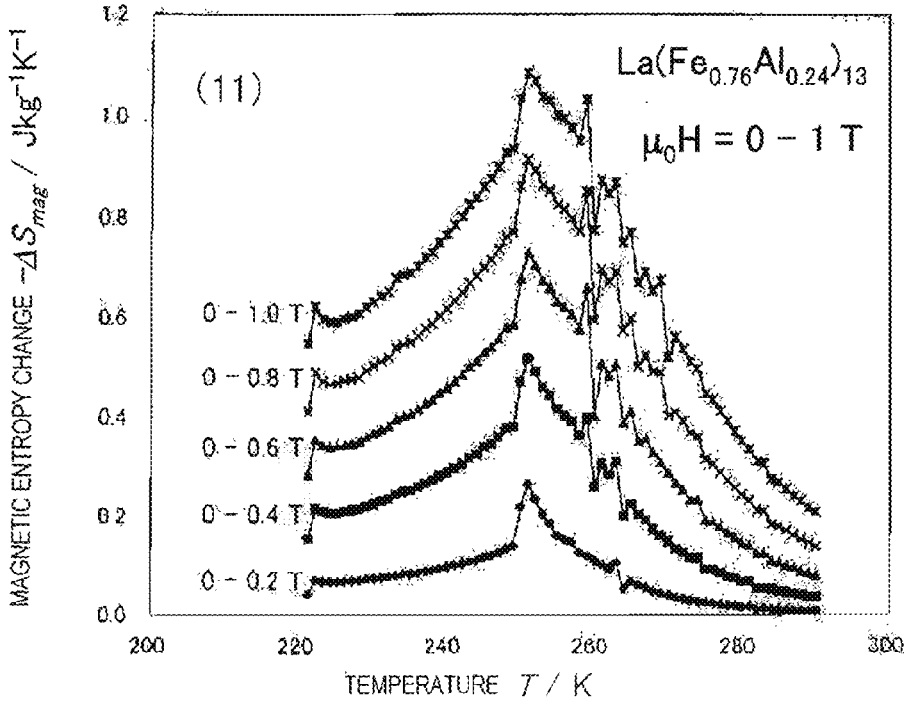

FIG. 20 is a graph showing $-\Delta S_{mag}$ of the rapidly solidified alloy including Al.

Figure 21:
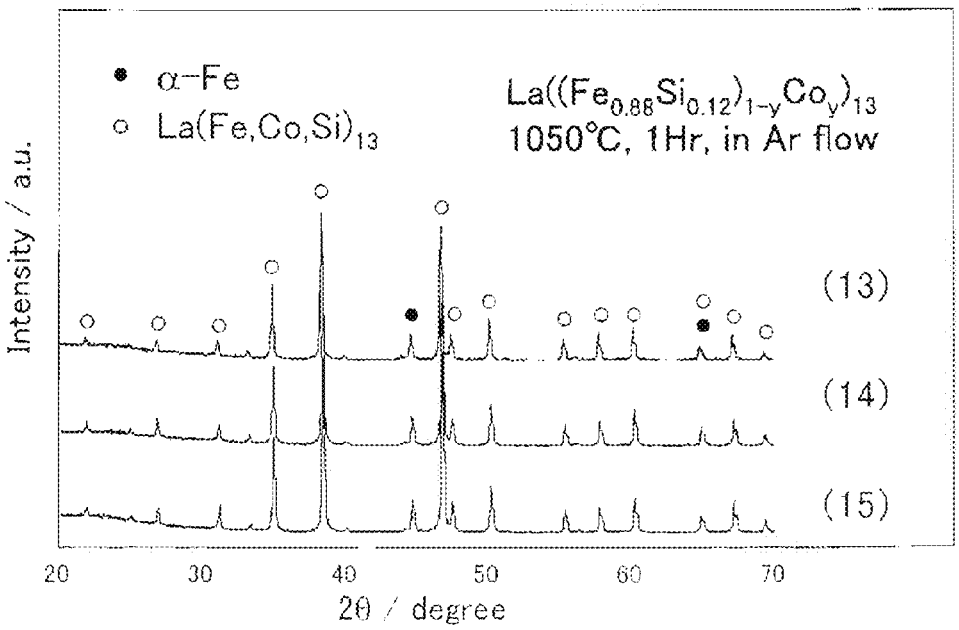

FIG. 21 shows the XRD data of a rapidly solidified alloy including Co.

Figure 22:
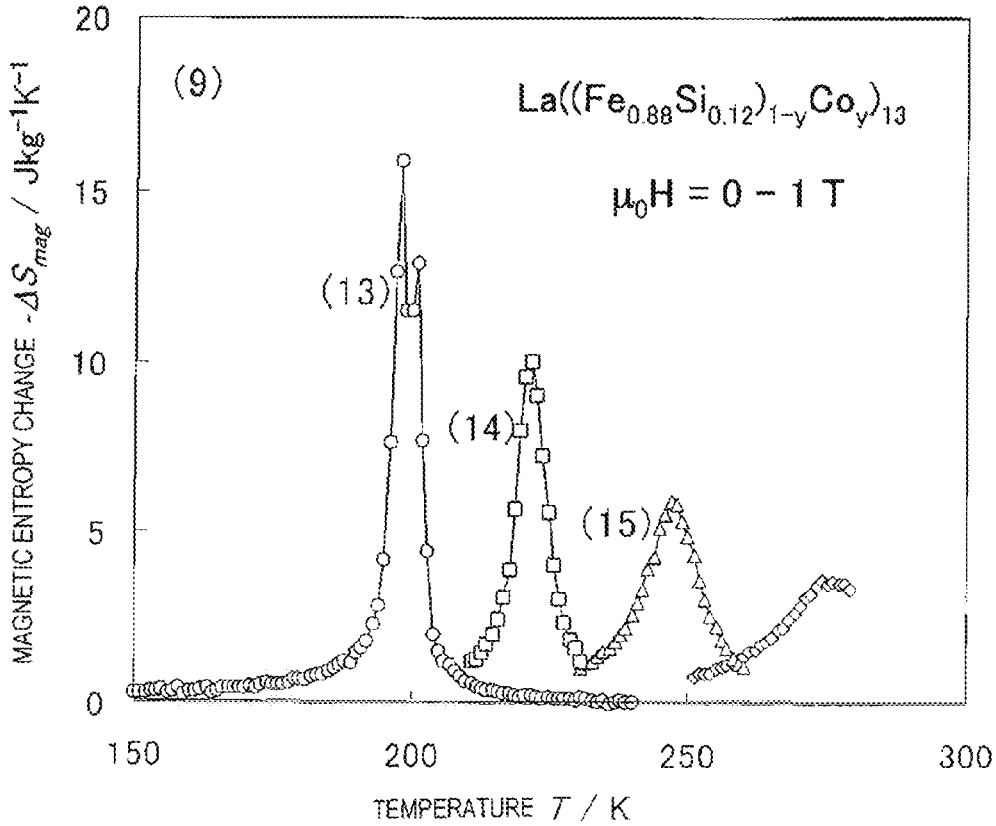

FIG. 22 is a graph showing $-\Delta S_{mag}$ of the rapidly solidified alloy including Co.

Figure 23:
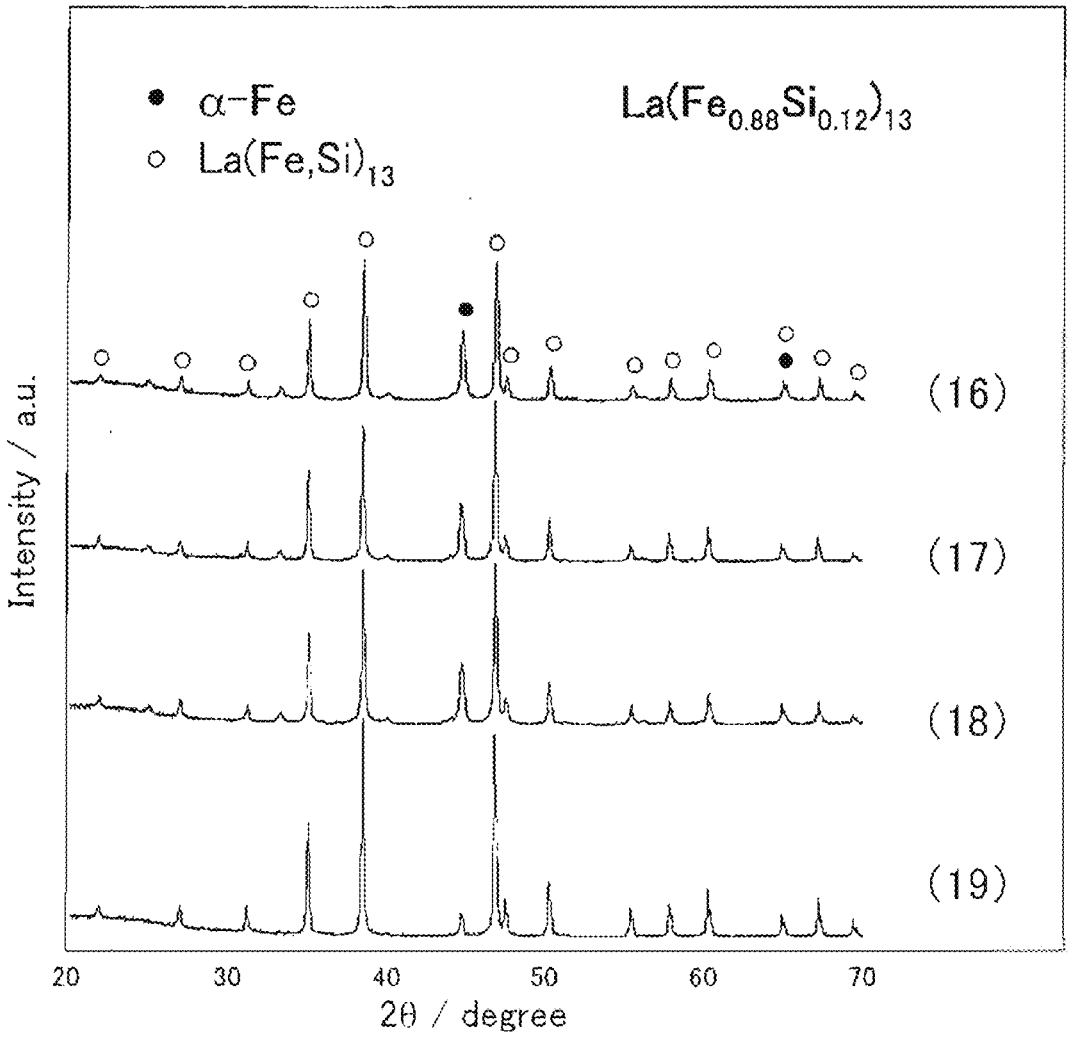

FIG. 23 shows the XRD data of a magnetic alloy that was thermally treated for as short as just one second.

Figure 24:
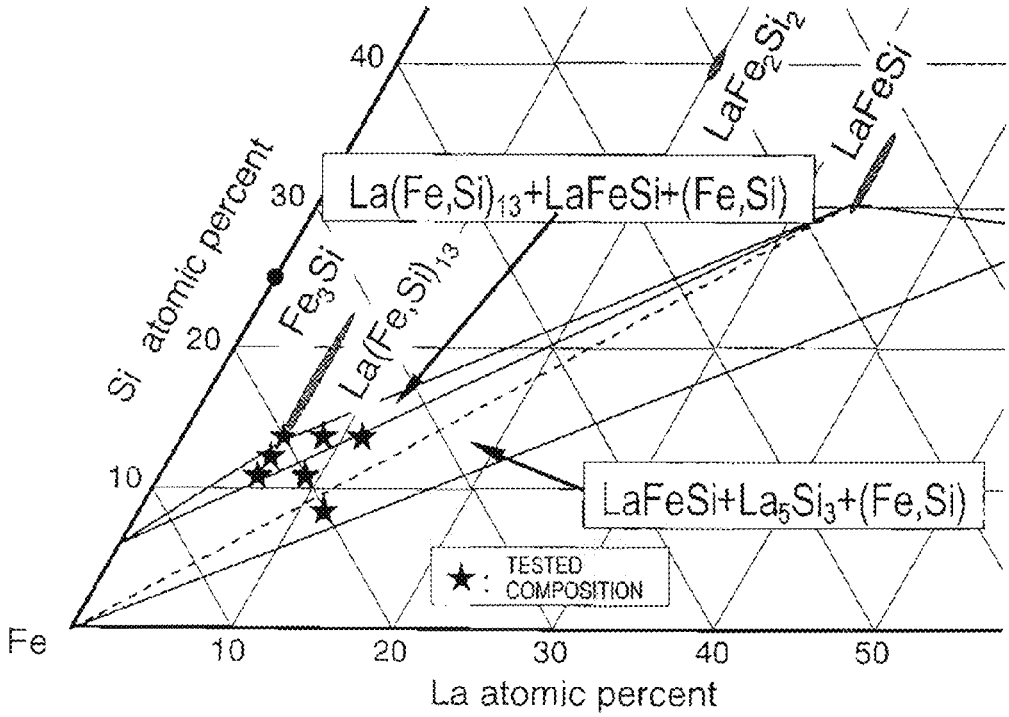

FIG. 24 is a ternary phase diagram of La—Fe—Si.

Figure 25:
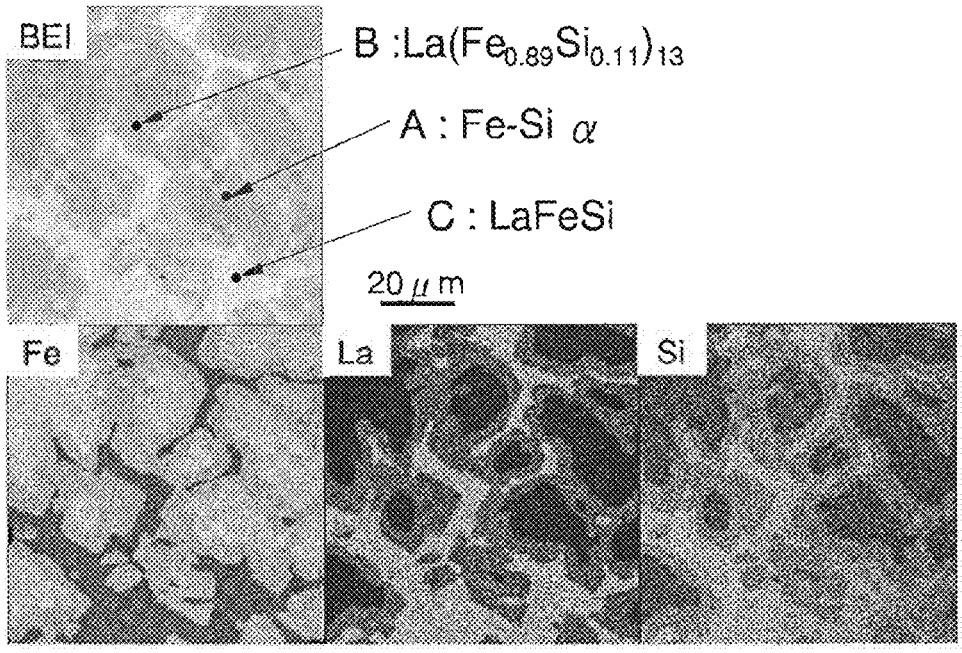

FIG. 25 shows photos representing a backscattered electron image (BEI) of an alloy sample, which was shot with an EPMA, and composition images thereof.

Figure 26:
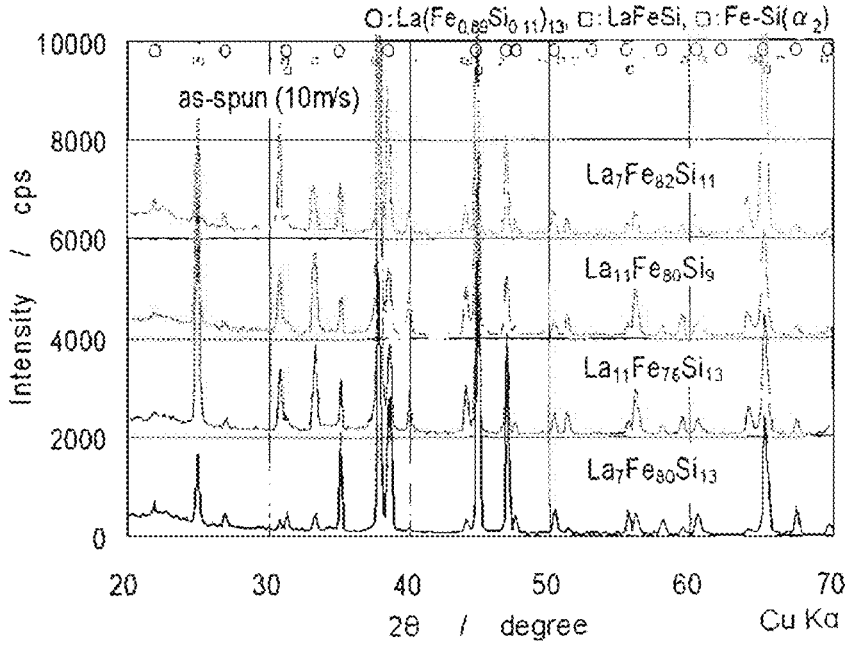

FIG. 26 shows the results of an XRD analysis that was carried out on rapidly solidified alloys.

Figure 27:
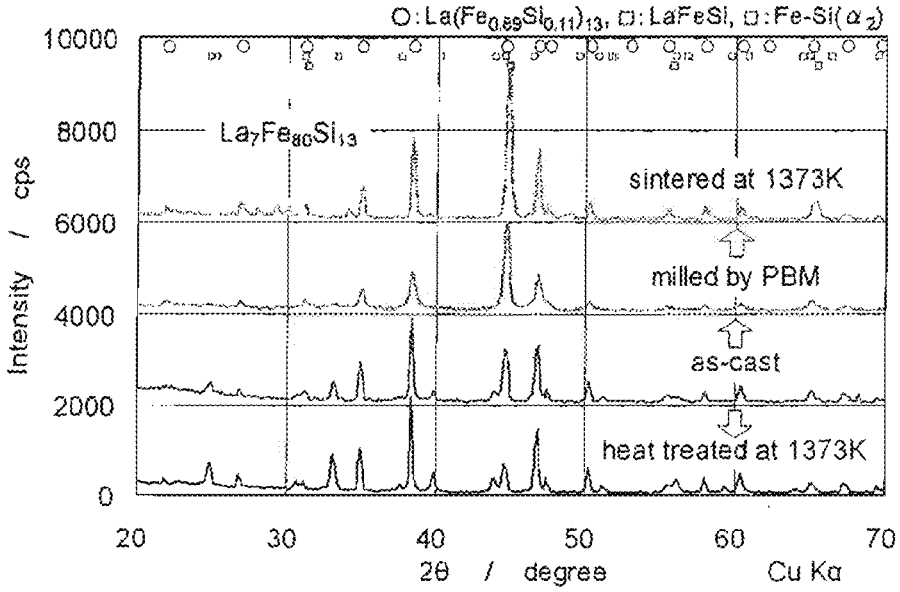

FIG. 27 shows changes in the constituent phases of an as-cast alloy, which were evaluated by an XRD analysis, in a situation where the alloy was sintered at 1,100° C.

Figure 28:
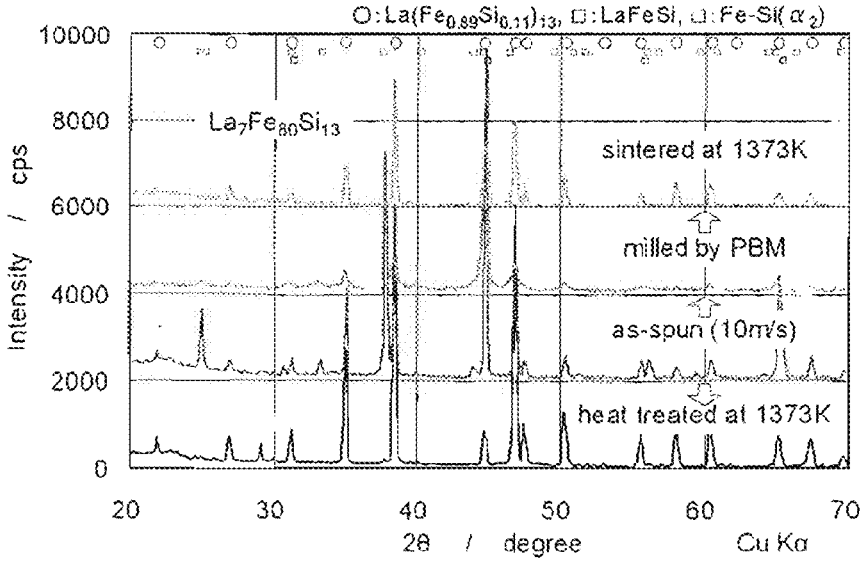

FIG. 28 shows changes in the constituent phases of a rapidly solidified alloy, which were evaluated by an XRD analysis, in a situation where the alloy was sintered at 1,100° C.

Figure 29:
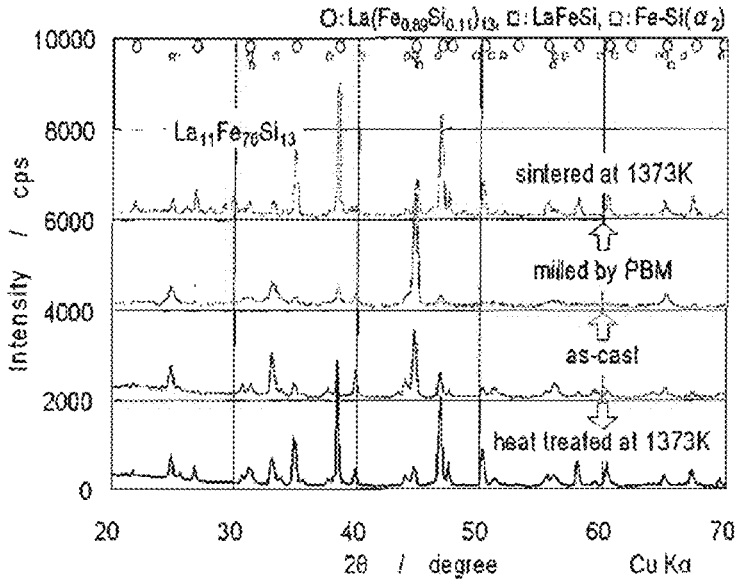

FIG. 29 shows changes in the constituent phases of an La-rich cast alloy, which were evaluated by an XRD analysis, in a situation where the alloy was sintered at 1,100° C.

Figure 30:
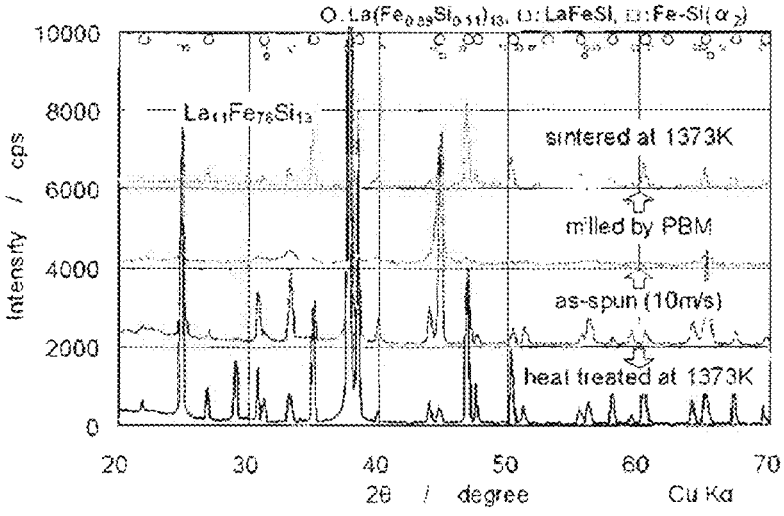

FIG. 30 shows changes in the constituent phases of an La-rich rapidly solidified alloy, which were evaluated by an XRD analysis, in a situation where the alloy was sintered at 1,100° C.

Figure 31A:
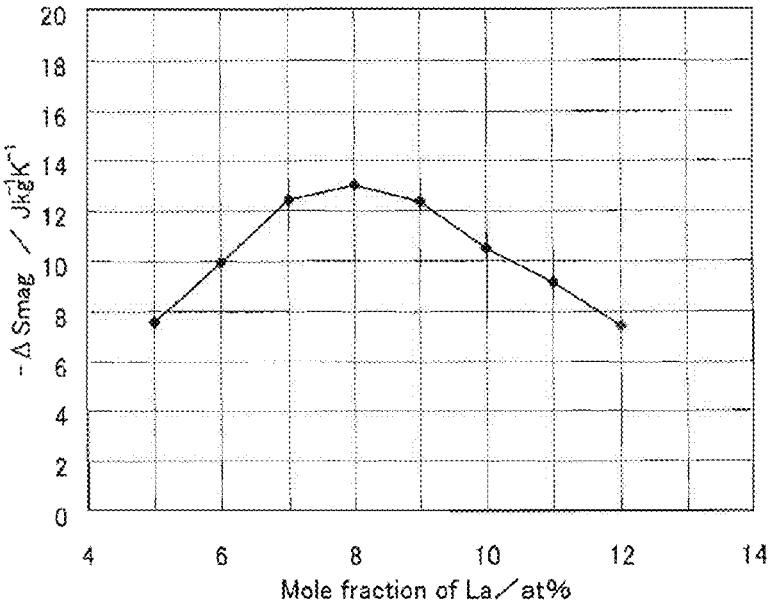

FIG. 31A is a graph showing a correlation between the mole fraction of La and the magnetocaloric effect ($-\Delta S_{mag}$).

Figure 31B:
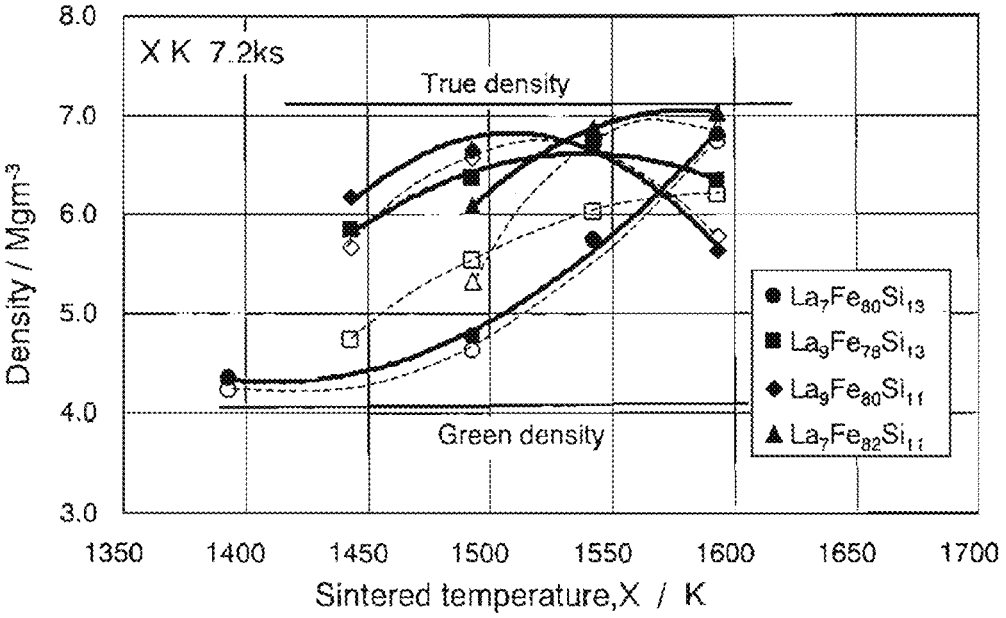

FIG. 31B is a graph showing how the density of a sintered body, made from a rapidly solidified alloy with any of various compositions, changed with its sintering temperature.

Figure 32:
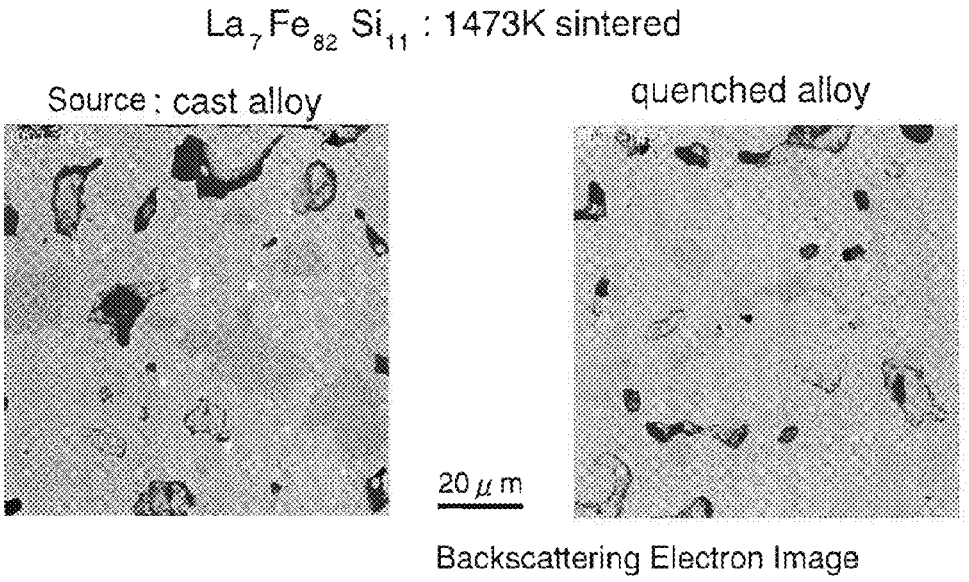

FIG. 32 shows EPMA backscattered electron images showing cross sections of sintered bodies that were obtained by sintering a material alloy with a composition $La_7Fe_{82}Si_{11}$ at 1,200° C.

Figure 33:
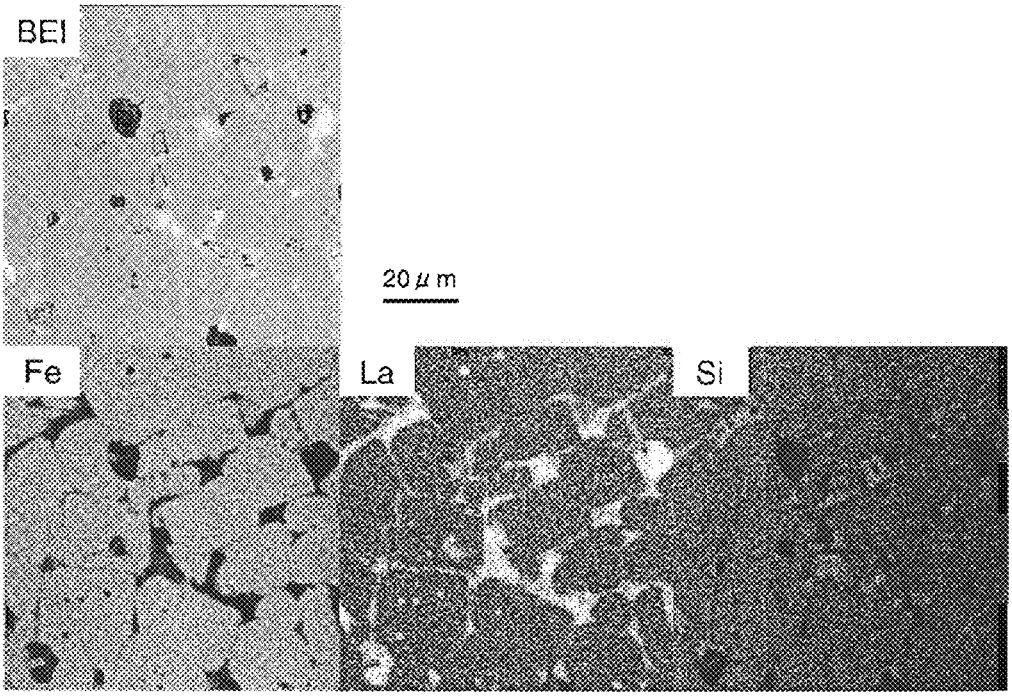

FIG. 33 shows an EPMA backscattered electron image (BEI) and composition images showing a cross section of a sintered body that was obtained by sintering a rapidly solidified alloy, having a composition $La_{11}Fe_{76}Si_{13}$, at 1,200° C.

Figure 34:
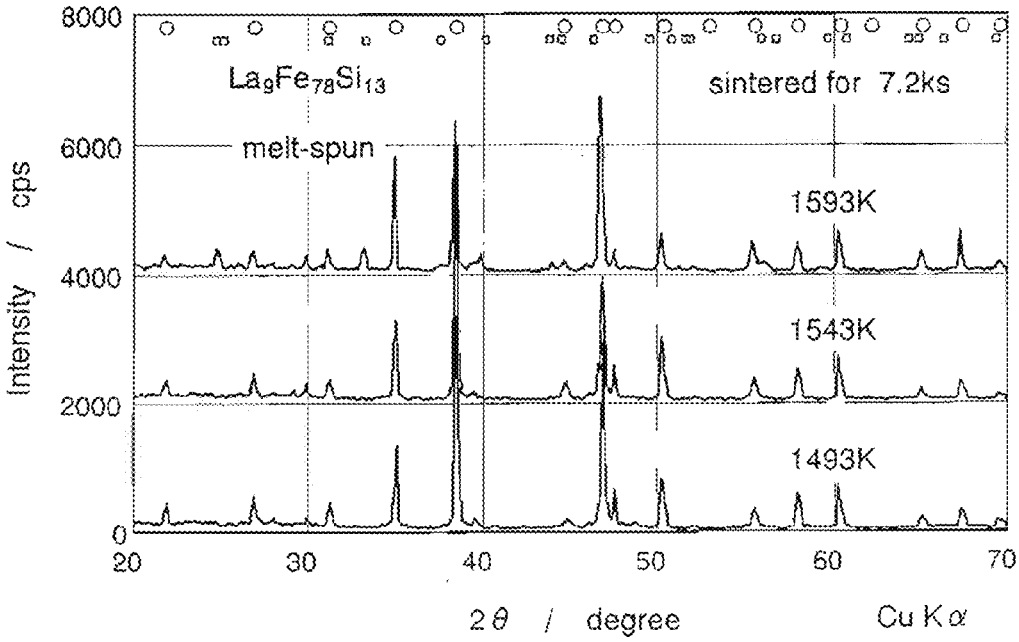

FIG. 34 shows the results of an XRD analysis on a sintered body that was obtained by sintering a rapidly solidified alloy having a composition $La_9Fe_{78}Si_{13}$ at various temperatures.

DESCRIPTION OF THE PREFERRED EMBODIMENTS

The present inventors wondered if by applying a powder metallurgical process to the rapidly solidified alloy disclosed in Patent Document No. 3 with the rapidly solidified alloy that has not been thermally treated yet (i.e., the as-spun alloy) used as a material alloy, the alloy could be processed into its final shape at a reduced cost and in a shorter time. And we also wondered if by sufficiently controlling the fine structure of the material alloy during the first process step, the target $NaZn_{13}$-type compound phase could be obtained by the sintering process only by diffusing the elements within the powder particles, not making them diffuse between the particles, which should take long hours.

With these ideas in mind, the present inventors carried out an extensive research to discover an as-spun alloy material that has a structure qualified for the material powder to make a compact of an La(Fe, Si) based magnetic refrigerant material.

[Basic Composition]

A magnetic alloy material according to the present invention has a composition represented by the general formula: $Fe_{100-a-b-c}RE_aA_bCo_c$, where RE is a rare-earth element that always includes La, A is either Si or Al, 6 at %≦a≦11 at %, 8 at %≦b≦18 at %, and 0 at %≦c≦9 at %, and having either a two phase structure consisting essentially of an α -Fe phase and an (RE, Fe, A) phase including 30 at % to 90 at % of RE or a three phase structure consisting essentially of the α -Fe phase, the (RE, Fe, A) phase including 30 at % to 90 at % of RE and an $RE(Fe, A)_{13}$ compound phase with an $NaZn_{13}$-type crystal structure. The respective phases have an average minor-axis size of 40 nm to 2 μm. RE is preferably at least one rare-earth element that is selected from the group consisting of La, Ce, Pr, Nd, Pm, Sm, Eu, Gd, Tb, Dy, Ho, Er and Tm and that includes 90 at % or more of La. A preferably always includes Si and more preferably is Si alone.

As shown in FIG. 24, which is a ternary phase diagram of La—Fe—Si at 600° C., $La(Fe, Si)_{13}$-type compounds have a wide range of Fe—Si ratios. However, a composition including a high percentage of Fe has a good ratio for a magnetic refrigerant material. An object of the present invention is to obtain a sintered body that is an $NaZn_{13}$-type compound with an Fe-rich compound composition in the end.

When a ternary composition of La—Fe—Si is used, for example, an LaFeSi compound including 30 at % or more of La is preferably included in a number of different La—Fe—Si compounds to get a target compound. However, if an $LaFe_2Si_2$ compound including less than 30 at % of La were produced, then the Fe—Si ratio in the resultant $NaZn_{13}$-type compound would be a rather Si-rich one and the performance as a magnetic refrigerant material would deteriorate. That is why RE in the (RE, Fe, A) phase, which should be included along with α -Fe, needs to account for at least 30 at %.

Meanwhile, depending on the alloy composition and the rapid solidification process, an eutectic structure, consisting of an $La_5(Fe, Si)_3$ compound phase, metal La and metal Fe, may be produced as an (RE, Fe, A) phase. However, this eutectic structure also contributes to producing an $La(Fe, Si)_{13}$-type compound as a target phase by producing LaFeSi during the heat treatment process. This eutectic structure consists of a number of different phases and is identified as rare-earth-rich portions in the gap between the α -(Fe, Si) phases that have grown as the primary crystals. Nevertheless, depending on the technique of analysis, this eutectic structure may sometimes be identified as a single rare-earth-rich phase (RE, Fe, A). The average composition thereof varies with the cooling conditions during the solidification process but its La concentration never exceeds approximately 90 at %, which is seen in an Fe—La eutectic composition. Thus, the upper limit of the RE concentration in the (RE, Fe, A) phase that should be present along with the α -Fe is set to 90 at %.

Furthermore, $La(Fe, Si)_{13}$ is not produced outside of a composition range in which α-(Fe, Si), LaFeSi and $La(Fe, Si)_{13}$ may coexist in the equilibria. To satisfy this condition, a lower limit needs to be set for the Si concentration. If the Si concentration were short of this lower limit, then the resultant composition would enter a composition range in which the three phases of α-(Fe, Si), $La_5(Fe, Si)_3$ and LaFeSi may coexist in the equilibria, thus producing no $La(Fe, Si)_{13}$ anymore. Since RE has a lower limit of 6 at %, the lower limit of A is set to approximately 8 at %. As will be described in detail later by way of specific examples, the lower limit of RE is preferably 7 at %, at which the lower limit of A is about 8.3 at %. Also, as the Si concentration increases, the Curie temperature of the resultant $La(Fe, Si)_{13}$ phase rises but the saturation magnetization and magnetocaloric effect decrease at the same time. If the Si concentration exceeded 18 at % (i.e., x=0.167), then the $-\Delta S_{mag}$ value would be less than 1 J/K/kg between the magnetizing fields of 0 T and 1 T applied to the alloy, thus making the material practically valueless. For that reason, the upper limit of the A concentration is set to 18 at %.

The preferred mole fraction of RE will be described in detail later by way of specific examples.

The magnetic alloy material (material alloy) of the present invention has rich viscosity and toughness, and therefore, the solidified primary crystals thereof, consisting essentially of a soft iron phase that decreases the pulverizability, have a size of 2 μm or less. Accordingly, the magnetic alloy can be easily finely pulverized in the as-spun state. In addition, since the elements need to diffuse just a short distance in the sintering reaction after the compaction, a sintered body with a highly uniform composition can be obtained by performing the sintering process in only a short time. As a result, a magnetic refrigerant material, which can be easily formed into any arbitrary shape, has magnetization that exhibits a steep temperature variation at the magnetic transition temperature, and has a giant magnetocaloric effect, can be obtained. The sintered body obtained by a powder metallurgical process using the magnetic alloy material (material alloy) of the present invention can be naturally used effectively as a magnetostrictive material, too.

[Minor-Axis Size of Crystal Grains]

The upper limit of the crystal grain size is determined by the diffusion distance during the sintering (heat treatment) process. For example, to produce a target phase by performing a heat treatment process at 900° C. for approximately one hour, the structure needs to have a size of about 3 μm or less. In addition, to keep the composition of the produced phase uniform, the structure should have an even smaller size, which needs to be less than the powder particle size required by a powder metallurgical process. The upper limit of the crystal grain size that satisfies all of these requirements is 2 μm. That is to say, if the size of the produced structure exceeded 2 μm, the efficiency of the fine pulverization process would fall steeply and the sintering process for getting the target phase or the heat treatment process to be carried out after the pulverization and powder compaction processes would be too long.

Meanwhile, the smallest possible crystal grain size realizable by an actual manufacturing process is 40 nm to 50 nm. If one tried to make crystal grains of even smaller sizes, then the rapidly solidified alloy would amorphize. In that case, it would be easy to obtain a material in thin flakes or in powder but it should be difficult to pulverize the amorphous alloy as it is. Thus, such an alloy is not suitable for a powder metallurgical process.

The crystal grain size is substantially determined by the quenching rate for a given composition. That is to say, the higher the quenching rate, the smaller the crystal grain size and the thinner the alloy. Since the thickness of the rapidly solidified alloy has a lower limit and the quenching rate has an upper limit, the lower limit of the average crystal grain size is determined as a secondary effect.

As will be described later, the present inventors carried out various experiments to discover that by optimizing the melt-quenching process conditions, an alloy, in which the respective constituent phases of the rapidly solidified alloy had an average minor-axis size of 40 nm to 2 μm, can be obtained.

[Oxygen Concentration]

Also, a magnetic alloy material according to a preferred embodiment of the present invention (i.e., a material alloy yet to be sintered) preferably has an oxygen concentration of 0.02 mass % to 0.05 mass % (corresponding to the range of 0.07 at % to 0.18 at %). A sintered body (as a magnetic refrigerant material) made of such a magnetic alloy material has a lower oxygen concentration than a conventional one and the value of the magnetic entropy change increases as a result.

The lower the oxygen concentration, the better. In the material melting, fine pulverization, and sintering process steps, oxygen is absorbed as an impurity and most of it combines with La, while part of it combines with Si. Not only the magnetic transition behavior but also the magnetocaloric effect of the target substance are sensitive to the La/(Fe+Si) ratio and the Fe/Si ratio. Oxygen is contained inevitably but its concentration is difficult to control. And the higher the oxygen concentration, the greater the magnitude of the magnetic property variation. As a result, a distribution of magnetic transition points is created within the substance, the transition loses its sharpness, and the magnetocaloric effect decreases.

To achieve a good magnetocaloric effect, the sintered body preferably has an oxygen concentration of 0.08 mass % or less and the material alloy preferably has an oxygen concentration of 0.05 mass % or less. Considering that the oxygen concentration always increases in a powder metallurgical process, the magnetic alloy material (material alloy) of the present invention preferably has an oxygen concentration of 0.02 mass % to 0.05 mass % (corresponding to the range of 0.07 at % to 0.18 at %).

[Melt-Quenching (Rapid Solidification) Process]

A magnetic alloy material having such a fine structure is made by rapidly quenching and solidifying a melt of the alloy material with the predetermined composition such that an average quenching rate becomes $2\times10^{4\circ}$ C./s to $2\times10^{6\circ}$ C./s within the temperature range of 1,500° C. to 600° C. The average quenching rate is preferably $2\times10^{5\circ}$ C./s or more.

Examples of preferred melt quenching processes include a gas atomization process, a single roller quenching process, a twin roller quenching process, a strip casting process and a melt spinning process. Among other things, the melt spinning process and strip casting process are preferred, because a ribbon of the rapidly solidified alloy with a thickness of 20 μm to 200 μm can be obtained highly efficiently by the melt spinning or strip casting process. It should be noted that the gas atomization process usually achieves a low quenching rate. And it is difficult to achieve an average quenching rate of $2\times10^{4\circ}$ C./s or more by the gas atomization process. However, by adopting a powder particle size as small as 50 μm or less, for example, a supercooling (ΔT) of 100 K or more and a quenching rate of $10^{5\circ}$ C./s will be achieved and spherical particles can be obtained. A powder consisting of such spherical particles can be easily mixed and kneaded with a polymer binder and the resultant compound has good moldability or flowability. Consequently, such powder can be used effectively as a material for a compound to be injection-molded.

Figure 1:
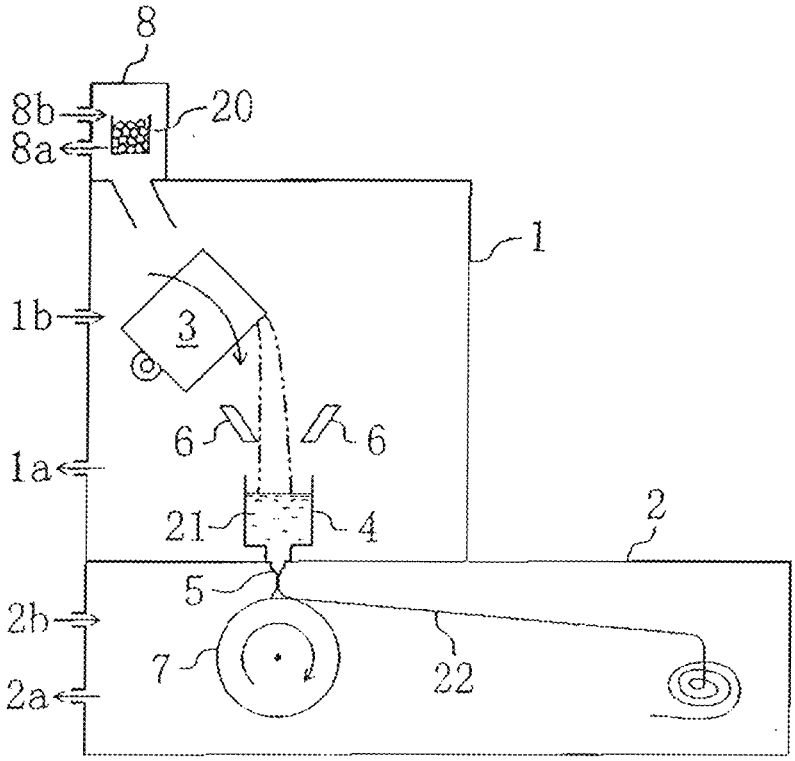
FIG. 1(*a*) is a cross-sectional view illustrating an overall arrangement of an apparatus for use to make a rapidly solidified alloy according to the present invention and FIG. 1(*b*) illustrates a portion of the apparatus, where a melt is rapidly quenched and solidified, on a larger scale.
Figure 1:
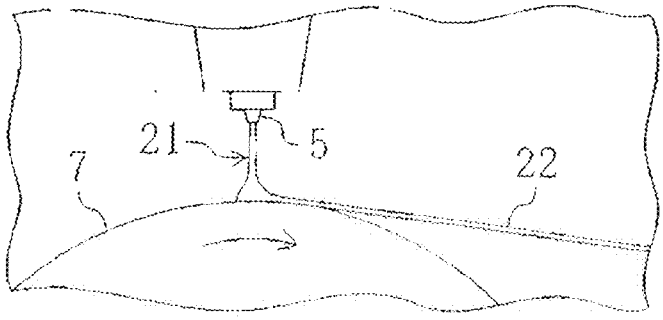

The rapidly solidified alloy may be obtained by performing a melt spinning process with a melt-quenching apparatus such as that shown in FIG. 1. The melt spinning process is preferably performed within an inert atmosphere to prevent the material alloy, which includes easily oxidizable rare-earth elements (i.e., La and RE in the general formula described above) and Fe, from being oxidized. The inert gas may be a rare gas such as helium or argon or a nitrogen gas, for example. The rare gas of helium or argon is preferred to the nitrogen gas, because nitrogen reacts with the rare-earth elements relatively easily.

The apparatus shown in FIG. 1 includes material alloy melting and quenching chambers 1 and 2, in which a vacuum or an inert atmosphere is maintained at an adjustable pressure. Specifically, FIG. 1(*a*) illustrates an overall arrangement of the apparatus, while FIG. 1(*b*) illustrates a portion of the apparatus on a larger scale.

As shown in FIG. 1(*a*), the melting chamber 1 includes: a melt crucible 3 to melt, at an elevated temperature, a material 20 that has been mixed to have a desired alloy composition; a reservoir 4 with a teeming nozzle 5 at the bottom; and a mixed material feeder 8 to supply the mixed material into the melt crucible 3 while maintaining an airtight condition. The reservoir 4 stores the melt 21 of the material alloy therein and is provided with a heater (not shown) to maintain the temperature of the melt teemed therefrom at a predetermined level.

The quenching chamber 2 includes a rotating chill roller 7 for rapidly quenching and solidifying the melt 21 that has been dripped through the teeming nozzle 5.

In this apparatus, the atmosphere and pressure inside the melting and quenching chambers 1 and 2 are controllable within prescribed ranges. For that purpose, atmospheric gas inlet ports 1*b*, 2*b* and 8*b* and outlet ports 1*a*, 2*a* and 8*a* are provided at appropriate positions of the apparatus. In particular, the gas outlet port 2*a* is connected to a pump to control the absolute pressure inside the quenching chamber 2 within a range of about 30 kPa to the normal pressure (i.e., atmospheric pressure), preferably 100 kPa or less. By changing the pressure inside of the melting chamber 1, the pressure on the melt being ejected through the nozzle 5 can be adjusted.

The melt crucible 3 may define a desired tilt angle to pour the melt 21 through a funnel 6 into the reservoir 4. The melt 21 is heated in the reservoir 4 by the heater (not shown).

The teeming nozzle 5 of the reservoir 4 is positioned on the boundary wall between the melting and quenching chambers 1 and 2 to drip the melt 21 in the reservoir 4 onto the surface of the chill roller 7, which is located under the nozzle 5. The orifice diameter of the teeming nozzle 5 may be 0.5 mm to 4.0 mm, for example. If the orifice diameter and/or the pressure difference (of 10 kPa or more, for example) between the melting and quenching chambers 1 and 2 are adjusted according to the viscosity of the melt 21, the melt 21 can be teemed smoothly. The apparatus for use in this preferred embodiment can feed the molten alloy at a rate of 1.5 kg/min to 10 kg/min. If the feeding rate exceeded 10 kg/min, then the resultant melt-quenching rate would be so low as to create a multi-layer structure, of which the texture changes in the thickness direction of the cast flakes. More preferably, the molten alloy is fed at a rate of 2 kg/min to 8 kg/min.

The chill roller 7 is preferably made of Cu, Fe or an alloy including Cu or Fe. This is because if the chill roller was made of a material other than alloys containing Cu or Fe, the resultant rapidly solidified alloy could not come off the chill roller easily and might be wound around the roller. The chill roller 7 may have a diameter of 300 mm to 500 mm, for instance. The water-cooling capability of a water cooler, provided inside of the chill roller 7, is preferably calculated and adjusted based on the latent heat of solidification and the volume of the melt teemed per unit time.

First, the melt 21 of the material alloy having the predetermined composition is prepared and stored in the reservoir 4 of the melting chamber 1 shown in FIG. 1. Next, the melt 21 is dripped through the teeming nozzle 5 onto the chill roller 7 to contact with, and be rapidly quenched and solidified by, the chill roller 7 within a low-pressure Ar atmosphere.

A period of time during which the molten alloy 21 is quenched by the chill roller 7 is equivalent to an interval between a point in time the alloy contacts with the outer circumference of the rotating chill roller 7 and a point in time the alloy leaves the roller 7. In this period of time, the alloy has its temperature decreased rapidly to be a supercooled liquid or a nearly amorphous solid. Thereafter, the supercooled alloy leaves the chill roller 7 and travels within the inert atmosphere. While the ribbon alloy is traveling, the alloy has its heat dissipated into the atmospheric gas. As a result, the temperature of the alloy further drops. In this preferred embodiment, the pressure of the atmospheric gas is 10 kPa to the normal pressure. By setting the atmospheric gas pressure to 30 kPa or more to increase the secondary cooling effect caused by the atmospheric gas, a ribbon rapidly solidified alloy with a homogenous texture can be obtained.

According to the present invention, the molten alloy does not have to be rapidly quenched and solidified by the single roller method described above but may also be quenched by a strip casting process, which is a rapid solidification process that requires no flow rate control with the nozzle orifice. In the strip casting process, no nozzle orifice is used, and therefore, the melt feeding rate can be increased and stabilized easily by adjusting the teeming rate. However, the atmospheric gas often cleaves into the gap between the chill roller and the melt to form gas pockets, thus possibly making the quenching rate non-uniform on the melt contact surface. To overcome these problems, the space in which the chill roller is provided should have its atmospheric gas pressure decreased to the range specified above such that the atmospheric gas will not be absorbed. Optionally, a gas atomization process may also be adopted although the productivity will somewhat decline in that case.

[Quenching Rate]

To make a rapidly solidified alloy having the fine structure described above in which the respective constituent phases of the crystal structure have an average minor-axis size of 40 nm to 2 μm, the average quenching rate in the temperature range of 1,500° C. to 600° C. is preferably $2\times10^{4}$° C./s to $2\times10^{6}$° C./s and more preferably at least $2\times10^{5}$° C./s.

When a cylindrical nozzle with a nozzle orifice diameter of 0.8 mm is used, the average quenching rate of $2\times10^{5}$° C./s is realized because the quenching rate is $2\times10^{5}$° C./s at a roller peripheral velocity of about 3 m/s and is $2\times10^{6}$° C./s at a roller peripheral velocity of about 30 m/s.

A strip casting process makes it possible to produce a wide strip continuously, thus increasing the weight of alloy that can be processed per unit time enormously. Meanwhile, the quantity of heat to be dissipated from the chill roller needs to be increased accordingly. That is why it is a task imposed on an engineer to strike an adequate balance between the productivity and the quantity of heat that can be actually dissipated from the roller. It is known by experience that the quenching rate realizable by a strip casting process is lower than that realizable by a melt-spinning process and is about $10^{3}$° C./s to about $4\times10^{5}$° C./s. For example, if a strip with a width of 10 mm and a thickness of 90 μm is produced using a chill roller including an internal water cooling structure with a diameter of 500 mm, the roller peripheral velocity that realizes the quenching rate of $2\times10^{5}$° C./s is within the range of 10 m/s to 15 m/s. The number of strips that can be made simultaneously is equal to that of the teeming ports of a tundish. The melt feeding rate per strip is typically in the range of 1 kg/min to 5 kg/min.

To realize a quenching rate falling within this range, specific teeming conditions and peripheral velocity of the chill roller are preferably defined as follows.

[Preferred Teeming Temperature Range]

The alloy represented by the general formula described above has a liquidus temperature of about 1,450° C. and the teeming temperature should exceed this temperature. Primary crystals of Fe are nucleated at the liquidus temperature or less. That is why if the teeming temperature were lower than the liquidus temperature, then a melt including excessively big primary crystals of Fe would be teemed onto the chill roller and the object of obtaining a fine structure could not be achieved. For that reason, the melt temperature needs to be sufficiently higher than the liquidus temperature. However, the temperature should not be excessively high because the quantity of heat that needs to be dissipated by the rapid solidification process increases proportionally to the absolute temperature. From an industrial standpoint, an appropriate melt temperature range is preferably controlled to have a width of as narrow as about 50° C. and is also preferably higher than the liquidus temperature by 50° C. to 150° C. The observable melt temperature in real operation is equipment-dependent as it varies depending on where the temperature is measured. Generally speaking, however, it would cause a smallest number of failures in the actual manufacturing process to measure the melt temperature either in a melt puddle in a tundish or in a melt crucible. Considering that the melt temperature may further decrease after the melt temperature was measured and before the melt reaches the chill roller, the lower limit of the teeming temperature is preferably higher than the liquidus temperature by at least 50° C.

[Thickness of Rapidly Solidified Alloy]

The thickness of a ribbon of the rapidly solidified alloy is substantially inversely proportional to the peripheral velocity of the chill roller, proportional to the weight of melt teemed per strip and per unit time, and is also inversely proportional to the width of the strip. The quenching rate, which is the most important parameter, is almost proportional to the peripheral velocity of the chill roller. That is why the thickness range of a ribbon of the rapidly solidified alloy is determined almost solely by a preferred range of the quenching rate. Examples of factors that determine these proportionality constants include the diameter and heat dissipation ability of the chill roller. The latter depends on the material, thickness, and internal water cooling structure of the roller and the flow rate and flow velocity of cooling water. Accordingly, the preferred thickness range of a rapidly solidified alloy ribbon is a relatively narrow range determined by the manufacturing equipment. In most cases, when the thickness is 20 μm, the upper limit of the average quenching rate of $2\times10^{6}$° C./s is realized. And when the thickness is 200 μm, the lower limit of the average quenching rate of $2\times10^{5}$° C./s is realized.

By defining the thickness of the rapidly solidified alloy ribbon, an alloy preparation process at an appropriate quenching rate can be guaranteed and an alloy with the structural feature of the present invention can be obtained more easily.

Hereinafter, the effects achieved by adopting the melt-quenching process will be described by way of reference experimental examples.

REFERENCE EXPERIMENTAL EXAMPLE NO. 1

[Molten Material Alloy Preparing Process Step]

First, respective materials La, Fe and Si in predetermined amounts were mixed together such that an $La(Fe, Si)_{13}$-type compound phase having a composition $La(Fe_{0.88}Si_{0.12})_{13}$ could be obtained. Then, the mixture was melted in a high frequency melting crucible, thereby obtaining a cast alloy. The cast alloy obtained in this manufacturing process step (i.e., as-cast alloy) will be referred to herein as "Sample (e)". It should be noted that a cast alloy that has not been thermally treated yet will sometimes be referred to herein as an "as-cast alloy" so as not to be confused with a rapidly solidified alloy that has not been thermally treated yet (i.e., an as-spun alloy).

[Rapid Quenching Process Step]

Using an experimental apparatus having the same configuration as that shown in FIG. 1, a melt of about 10 g of an ingot cast alloy was ejected through a quartz nozzle with a diameter of 0.8 mm onto a Cu roller that was rotating at a velocity of 20 m/s, thereby obtaining an alloy ribbon. The alloy ribbon obtained in this process step (i.e., an as-spun alloy) will be referred to herein as "Sample (a)".

[Heat Treatment Process Step]

Sample (a) was wrapped in an Nb foil, introduced into a quartz tube and then thermally treated at 1,000° C. for one hour while evacuating the quartz tube to a vacuum of substantially 10 Pa or less with a rotary pump. The rapidly solidified alloy obtained in this manner will be referred to herein as "Sample (b)".

On the other hand, Sample (a) was also introduced airtight into a quartz tube that had been evacuated to a vacuum of $10^{-2}$ Pa or less, and then thermally treated at 1,050° C. for 24 hours. The rapidly solidified alloy obtained in this manner will be referred to herein as "Sample (c)". Furthermore, Sample (a) was also introduced airtight into the same quartz tube, and then thermally treated at the same temperature but for 120 hours. The rapidly solidified alloy obtained in this manner will be referred to herein as "Sample (d)".

About 10 g of Sample (e) (i.e., the cast alloy) was introduced airtight into a quartz tube that had been evacuated to a vacuum of $10^{-2}$ Pa or less and then thermally treated at 1,050° C. for 1 hour, 24 hours and 120 hours, respectively. The resultant cast alloys will be referred to herein as "Samples (f), (g) and (h)", respectively.

[Evaluation]

The crystal structures of the respective samples were evaluated by an X-ray diffraction (XRD) analysis. The XRD analysis was carried out on powders that had been obtained by pulverizing the respective samples to a size of 150 μm or less. In the XRD analysis, Cu was used as a target, the scan speed was 4.0 degrees per minute, the sampling width was 0.02 degrees and the measuring range was 20 degrees to 80 degrees.

The heat treatment conditions of the resultant Samples (a) through (h) and the phases that were produced in the respective alloys are shown in the following Table 1:

TABLE 1

| Sample | Heat treatment conditions | | | Produced phases | | |
|---|---|---|---|---|---|---|
| (a) | — | — | — | $La(Fe,Si)_{13}$ | ◎ α-Fe | (La,Fe,Si) |
| (b) | 1,000° C. | 1 hr | 10 Pa | ◎ $La(Fe,Si)_{13}$ | α-Fe | — |
| (c) | 1,050° C. | 24 hrs | $10^{-2}$ Pa | ◎ $La(Fe,Si)_{13}$ | α-Fe | — |
| (d) | 1,050° C. | 120 hrs | $10^{-2}$ Pa | ◎ $La(Fe,Si)_{13}$ | α-Fe | — |
| (e) | — | — | — | — | ◎ α-Fe | (La,Fe,Si) |
| (f) | 1,050° C. | 1 hr | $10^{-2}$ Pa | $La(Fe,Si)_{13}$ | ◎ α-Fe | (La,Fe,Si) |
| (g) | 1,050° C. | 24 hrs | $10^{-2}$ Pa | ◎ $La(Fe,Si)_{13}$ | α-Fe | (La,Fe,Si) |
| (h) | 1,050° C. | 120 hrs | $10^{-2}$ Pa | ◎ $La(Fe,Si)_{13}$ | α-Fe | — |

In Table 1, phases with ◎ are represented by main peaks in an XRD chart.

The modes and composition distributions of the respective samples were evaluated with an electron probe microanalyzer (EPMA). The samples to be observed with the EPMA were obtained in the following manner. Specifically, the respective sample alloys were impregnated with an epoxy resin, had their surfaces polished, and then coated with Au to a thickness of about 20 nm by an evaporation process. The EPMA was used with an acceleration voltage of 15 kV applied. A beam current of 1.0 nA was supplied in backscattered electron image (BEI) scanning.

The magnetic properties (or magnetocaloric effects) of the respective samples were evaluated. A magnetic refrigerant material preferably exhibits as great a magnetocaloric effect as possible. The magnetocaloric effect is normally evaluated by the magnetic entropy change $-\Delta S_{mag}$. Generally speaking, the greater the magnetic entropy change $-\Delta S_{mag}$, the more significant the magnetocaloric effect. The magnetization (M)-temperature (T) curve of each sample was obtained with a magnetic field having a constant strength applied thereto. Using a high-field vibrating sample magnetometer (VSM), the field strength was changed from 0 T to 1 T at regular intervals of 0.2 T. Based on the results of measurement, the magnetic entropy change $-\Delta S_{mag}$ was calculated by the following Equation (1):

$$-\Delta S_{mag}=\int_0^H(\partial M/\partial T)_H dH \quad (1)$$

where $-\Delta S_{mag}$ is the magnetic entropy change, H is the magnetic field, M is the magnetization and T is the absolute temperature.

Figure 2:
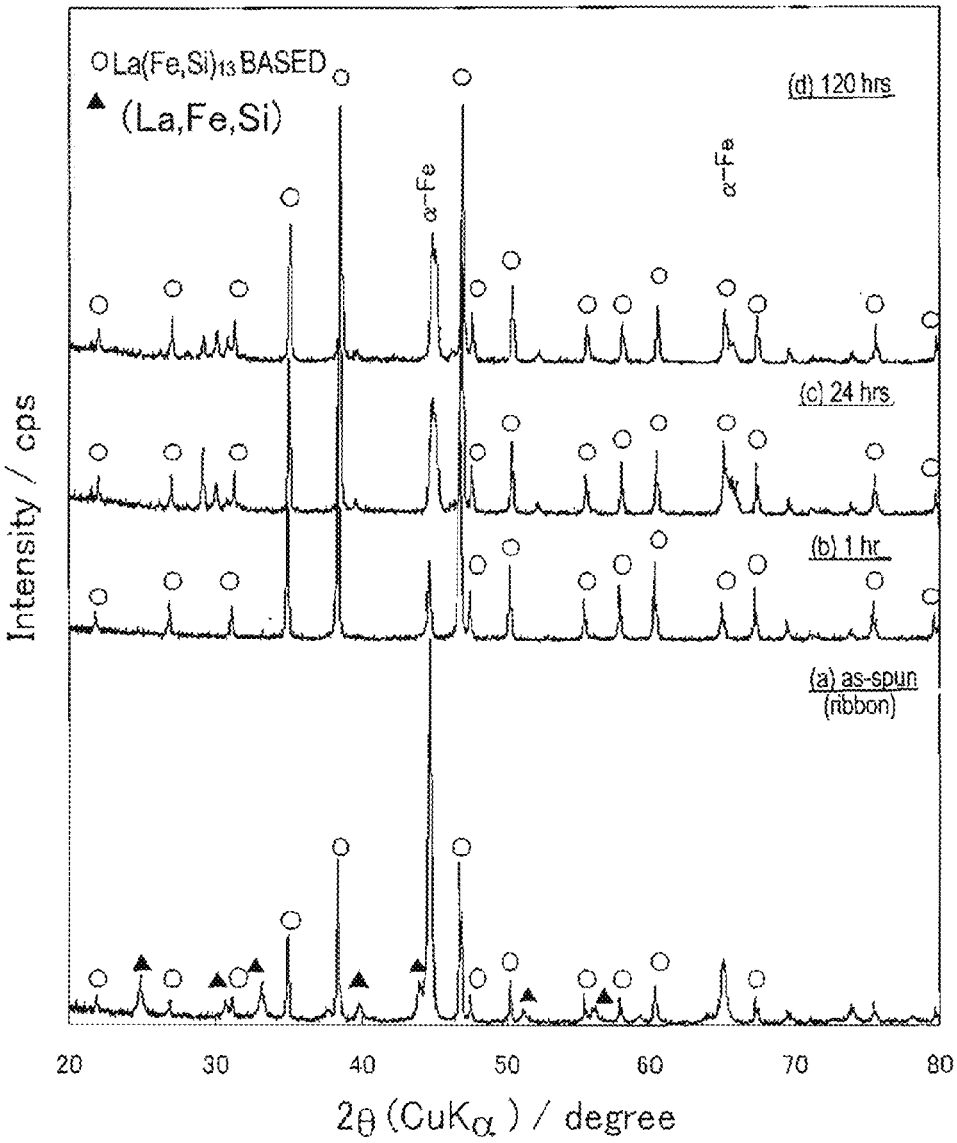
FIG. 2 is a graph showing the results of an XRD analysis that was carried out on Samples (a), (b), (c) and (d) made of the rapidly solidified alloys.
Figure 3:
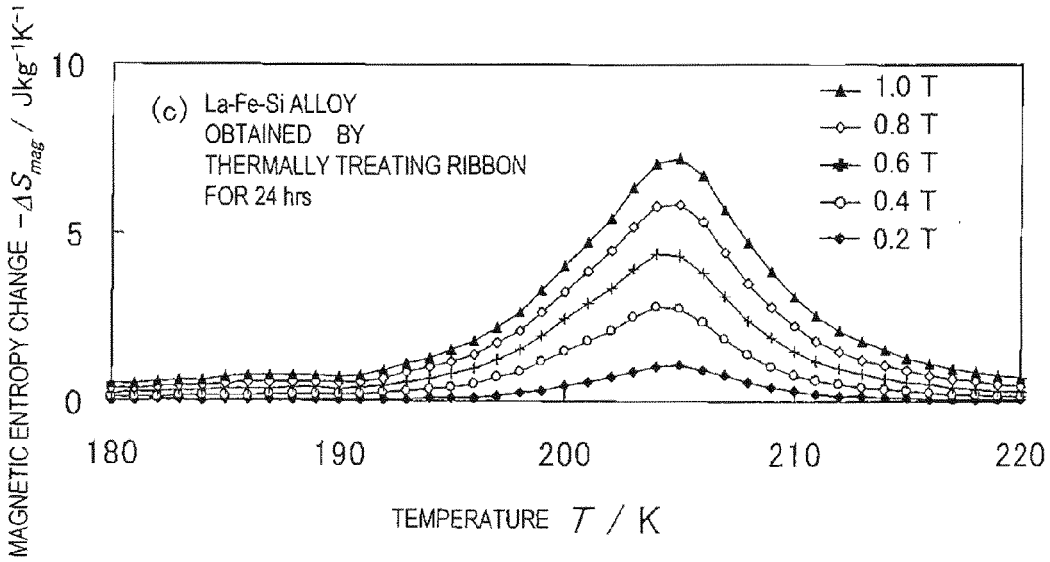
FIG. 3 is a graph showing how $-\Delta S_{mag}$ of Sample (c), made of the rapidly solidified alloy, varied with the temperature.
Figure 4:
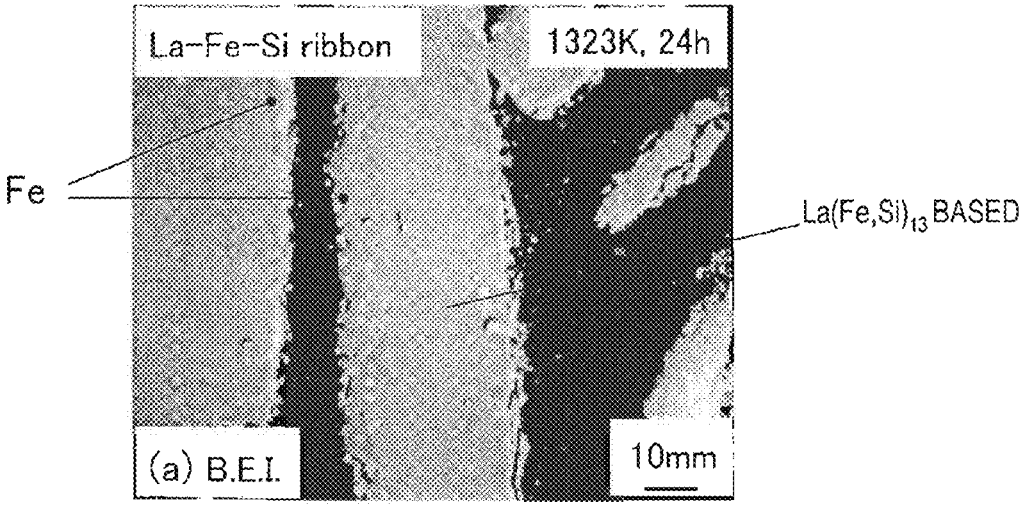
FIG. 4 is a micrograph showing a backscattered electron image (BEI) that was obtained by analyzing Sample (c), made of the rapidly solidified alloy, with an EPMA.

FIG. 2 shows the results of an XRD analysis that was carried out on Samples (a), (b), (c) and (d) obtained from the rapidly solidified alloys. FIG. 3 shows how the magnetic entropy change $-\Delta S_{mag}$ of Sample (c) varied with the temperature. FIG. 4 shows a BEI that was obtained by analyzing Sample (c) with the EPMA.

Figure 5:
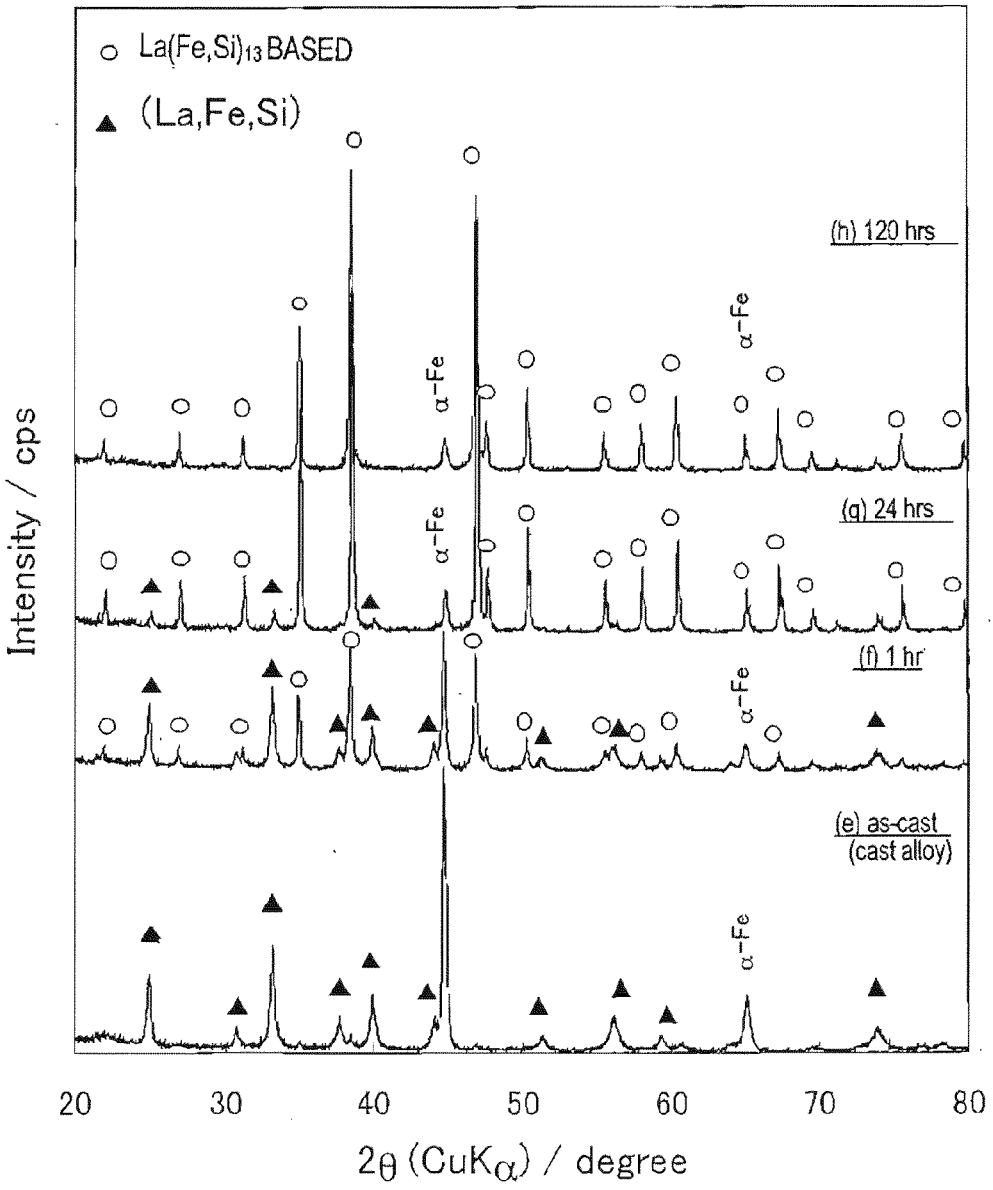
FIG. 5 is a graph showing the results of an XRD analysis that was carried out on Samples (e), (f), (g) and (h) made of cast alloys.
Figure 6:
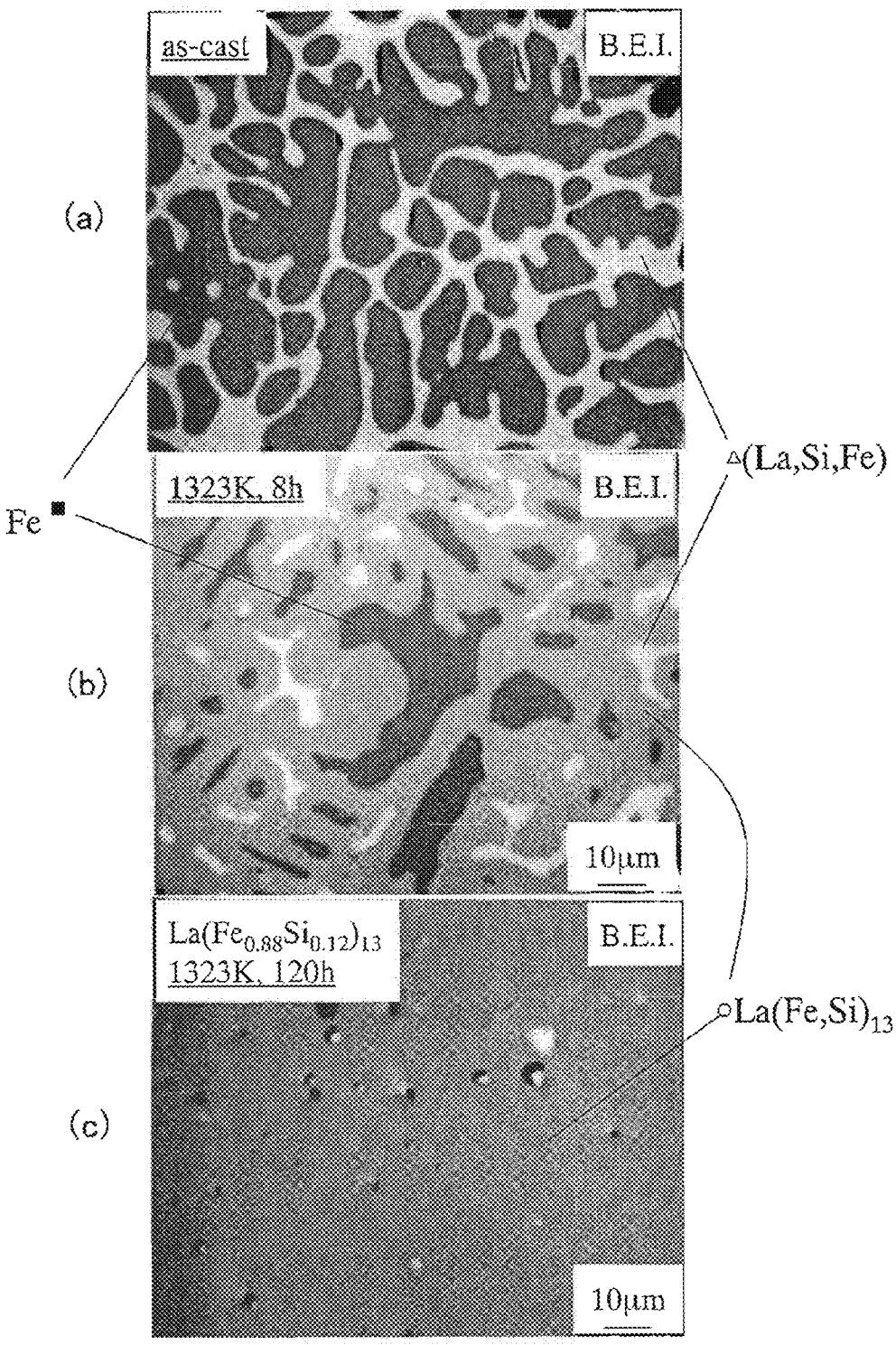
FIG. 6 is micrographs showing BEIs that were shot by analyzing the samples, made of the cast alloys, with the EPMA.

For the purpose of comparison, FIG. 5 shows the results of an XRD analysis that was carried out on Samples (e), (f), (g) and (h) obtained from the cast alloys. FIGS. 6(*a*) and 6(*c*) show BEIs that were obtained by analyzing Samples (e) and (h) with the EPMA. FIG. 6(*b*) shows a BEI of a sample that was thermally treated for 8 hours.

Hereinafter, the difference in structure between the rapidly solidified alloy samples and the cast alloy samples will be described with reference to FIGS. 2 and 5.

As can be seen from FIG. 2, as to the rapidly solidified alloys, even the as-cast alloy (i.e., Sample (a)) already included an $La(Fe, Si)_{13}$-type compound phase as indicated by the open circles ○. It should be noted that Sample (a) also included an (La, Fe, Si) compound phase consisting of La, Fe and Si as indicated by the solid triangles ▲ and an α -Fe phase. However, Sample (b), obtained by thermally treating Sample (a) for one hour, included almost no (La, Fe, Si) compound phase and significantly decreased α -Fe phase. Thereafter, even if the heat treatment process was carried out for an extended period of time, almost no variations were observed except that the peaks representing the α -Fe phase increased their intensities to a certain degree. Thus, it can be seen that in this case, the rapidly solidified alloy turned into the $La(Fe, Si)_{13}$-type compound phase almost entirely by being thermally treated for approximately one hour. Also, as can be seen from the BEI of Sample (c) shown in FIG. 4, almost the entire ribbon had a substantially uniform composition distribution except that a large amount of Fe was present around the surfaces of the ribbon.

Furthermore, as can be seen from the temperature dependence of the magnetic entropy change $-\Delta S_{mag}$ as shown in FIG. 3, Sample (c) (a rapidly solidified alloy) showed great magnetic entropy changes. Specifically, $-\Delta S_{mag}$ between 0 T and 1 T measured 7.5 $Jkg^{-1} K^{-1}$. Gadolinium (Gd), which is often used in a currently available magnetic refrigeration experimental machines operating at around room temperature, shows $-\Delta S_{mag}$ of about 3 $Jkg^{-1} K^{-1}$ between 0 T and 1 T. Thus, it can be seen that this rapidly solidified alloy shows a greater magnetic entropy change $-\Delta S_{mag}$ than Gd. Having had its surface oxide layer (with a thickness of about 2 μm) removed, Sample (h), obtained from a cast alloy, showed $-\Delta S_{mag}$ of 19 $Jkg^{-1} K^{-1}$. Sample (c) showed a lower $-\Delta S_{mag}$ than Sample (h) probably due to the presence of the surface oxide layer. However, considering the industrial applicability, this decrease in $-\Delta S_{mag}$ is much less significant than various effects of the present invention to be achieved by shortening the heat treatment time, cutting down the material cost, and simplifying the pulverization process. As also can be seen from FIG. 3, the temperature range in which Sample (c) exhibits the magnetic phase transition has a half width ΔTc of 30 K or more, thus realizing a broad operating temperature range as a magnetic refrigerant material, too.

On the other hand, as can be seen from the results of the XRD analysis that was carried out on Samples (e) through (h), obtained from the conventional cast alloy, as shown in FIG. 5 and from the BEIs shown in FIG. 6, the as-cast alloy (i.e., Sample (e)) included no $La(Fe, Si)_{13}$-type compound phase, but the alloy being thermally treated gradually lost the (La, Fe, Si) compound phase and α -Fe phase and gradually gained the $La(Fe, Si)_{13}$-type compound phase. Also, comparing the results shown in FIG. 2 with those shown in FIG. 5, it can be seen that Sample (b), obtained by thermally treating the as-cast rapidly solidified alloy for one hour, included almost no (La, Fe, Si) compound phase, while Sample (g), obtained by thermally treating the conventional cast alloy for 24 hours, still included some (La, Fe, Si) compound phase.

To describe how the $La(Fe, Si)_{13}$-type compound is produced by the solid-phase diffusion reaction, FIG. 25 shows an exemplary cast alloy structure. More specifically, FIG. 25 shows a backscattered electron image (BEI) that was shot with an EPMA and composition images that were taken by a fluorescent X-ray. The distribution of respective elements can be checked by the fluorescent X-ray images. It can be seen how an $La(Fe, Si)_{13}$-type compound is formed by a peritectic reaction in which an LaFeSi liquid phase acts on an α -solid solution. A quantitative analysis using an EPMA showed that the concentration of Si in an α -Fe phase was in the range of 1.8 at % to 8.5 at %. If the amount of La is increased, then not only these phases but also an La—Si compound will be produced as well. The results of a thermal analysis revealed that this composition had a liquidus of 1,675 K, a peritectic point of 1,575 K and a freezing point of 1,511 K. It should be because of this high freezing point that this composition is hard to homogenize. The same statement also applies to a rapidly solidified alloy. To realize an appropriate composition in the end, an alloy in which 1.5 at % to 10 at % of Si is included as a solid solution would be preferred for an α -Fe phase. This is because if the solid solution of Si accounted for more than 10 at %, then the Fe—Si ratio of the $La(Fe, Si)_{13}$-type compound to be produced by the peritectic reaction would be too rich in Si to prevent the magnetic properties from deteriorating.

Thus, by thermally treating the rapidly solidified alloy for just a short period of time, an $La(Fe, Si)_{13}$ based magnetic alloy, including the $La(Fe, Si)_{13}$-type compound phase as a main phase, can be obtained.

REFERENCE EXPERIMENTAL EXAMPLE NO. 2

The present inventors carried out experiments on La—Fe—Si alloys that were made by the melt-quenching process to find the best heat treatment process time. The results will be described below.

[Making Samples]

As in Experimental Example No. 1 described above, respective materials La, Fe and Si in predetermined amounts were mixed together such that an $La(Fe, Si)_{13}$-type compound phase having a composition $La(Fe_{0.88}Si_{0.12})_{13}$ could be obtained. Then, the mixture was melted in a high frequency melting crucible, thereby obtaining a cast alloy. Thereafter, a melt of about 10 g of the resultant ingot cast alloy was ejected through a quartz nozzle with a diameter of 0.8 mm onto a Cu roller that was rotating at a velocity of 20 m/s, thereby obtaining an alloy ribbon as Sample (i) (as-spun alloy).

Subsequently, Sample (i) was thermally treated at 1,050° C. within an Ar atmosphere for 1 minute, 5 minutes, 10 minutes, 30 minutes and 60 minutes. The alloy ribbons obtained in this manner will be referred to herein as "Samples (j), (k), (l), (m) and (n)", respectively.

Also, five more cast alloys, having compositions represented by $La(Fe_{1-x}Si_x)_{13}$ (where x=0.10, 0.11, 0.12, 0.13, and 0.14), were prepared by the method described above. Then, the respective cast alloys were processed into alloy ribbons by the process described above. In this process, however, the Cu roller was rotated at a velocity of 10 m/s.

Subsequently, the resultant alloy ribbons were wrapped in Nb foils and thermally treated at 1,050° C. within an Ar atmosphere for 1 hour. The alloy ribbons obtained in this manner will be referred to herein as "Samples (o), (p), (q), (r) and (s)", respectively.

For the purpose of comparison, about 10 g of each of the cast alloys was introduced airtight into a quartz tube that had been evacuated to a vacuum of $10^{-2}$ Pa or less and then thermally treated at 1,050° C. for 120 hours. The resultant cast alloys will be referred to herein as "Samples (t), (u), (v), (w) and (x)", respectively.

The compositions and processing conditions of Samples (i) through (s) obtained by the melt-quenching process and Samples (t) through (x) obtained by the casting process are shown in the following Table 2:

TABLE 2

| Sample | Composition (at %) | Quenching condition Roller velocity | Heat treatment conditions Temperature/atmosphere/time |
|---|---|---|---|
| (i) | $La(Fe_{0.88}Si_{0.12})_{13}$ | 20 m/s | — |
| (j) | $La(Fe_{0.88}Si_{0.12})_{13}$ | 20 m/s | 1,050° C./Ar gas/1 min |
| (k) | $La(Fe_{0.88}Si_{0.12})_{13}$ | 20 m/s | 1,050° C./Ar gas/5 min |
| (l) | $La(Fe_{0.88}Si_{0.12})_{13}$ | 20 m/s | 1,050° C./Ar gas/10 min |
| (m) | $La(Fe_{0.88}Si_{0.12})_{13}$ | 20 m/s | 1,050° C./Ar gas/30 min |
| (n) | $La(Fe_{0.88}Si_{0.12})_{13}$ | 20 m/s | 1,050° C./Ar gas/1 hr |
| (o) | $La(Fe_{0.90}Si_{0.10})_{13}$ | 10 m/s | 1,050° C./Ar gas/1 hr |
| (p) | $La(Fe_{0.89}Si_{0.11})_{13}$ | 10 m/s | 1,050° C./Ar gas/1 hr |
| (q) | $La(Fe_{0.88}Si_{0.12})_{13}$ | 10 m/s | 1,050° C./Ar gas/1 hr |
| (r) | $La(Fe_{0.87}Si_{0.13})_{13}$ | 10 m/s | 1,050° C./Ar gas/1 hr |
| (s) | $La(Fe_{0.86}Si_{0.14})_{13}$ | 10 m/s | 1,050° C./Ar gas/1 hr |
| (t) | $La(Fe_{0.90}Si_{0.10})_{13}$ | — | 1,050° C./vacuum(<$10^{-2}$ Pa)/ 120 hrs |
| (u) | $La(Fe_{0.89}Si_{0.11})_{13}$ | — | 1,050° C./vacuum(<$10^{-2}$ Pa)/ 120 hrs |
| (v) | $La(Fe_{0.88}Si_{0.12})_{13}$ | — | 1,050° C./vacuum(<$10^{-2}$ Pa)/ 120 hrs |
| (w) | $La(Fe_{0.87}Si_{0.13})_{13}$ | — | 1,050° C./vacuum(<$10^{-2}$ Pa)/ 120 hrs |
| (x) | $La(Fe_{0.86}Si_{0.14})_{13}$ | — | 1,050° C./vacuum(<$10^{-2}$ Pa)/ 120 hrs |

where Samples (i) through (s) represent specific examples of the present invention while Samples (t) through (x) represent comparative examples.

[Evaluation]

Figure 7:
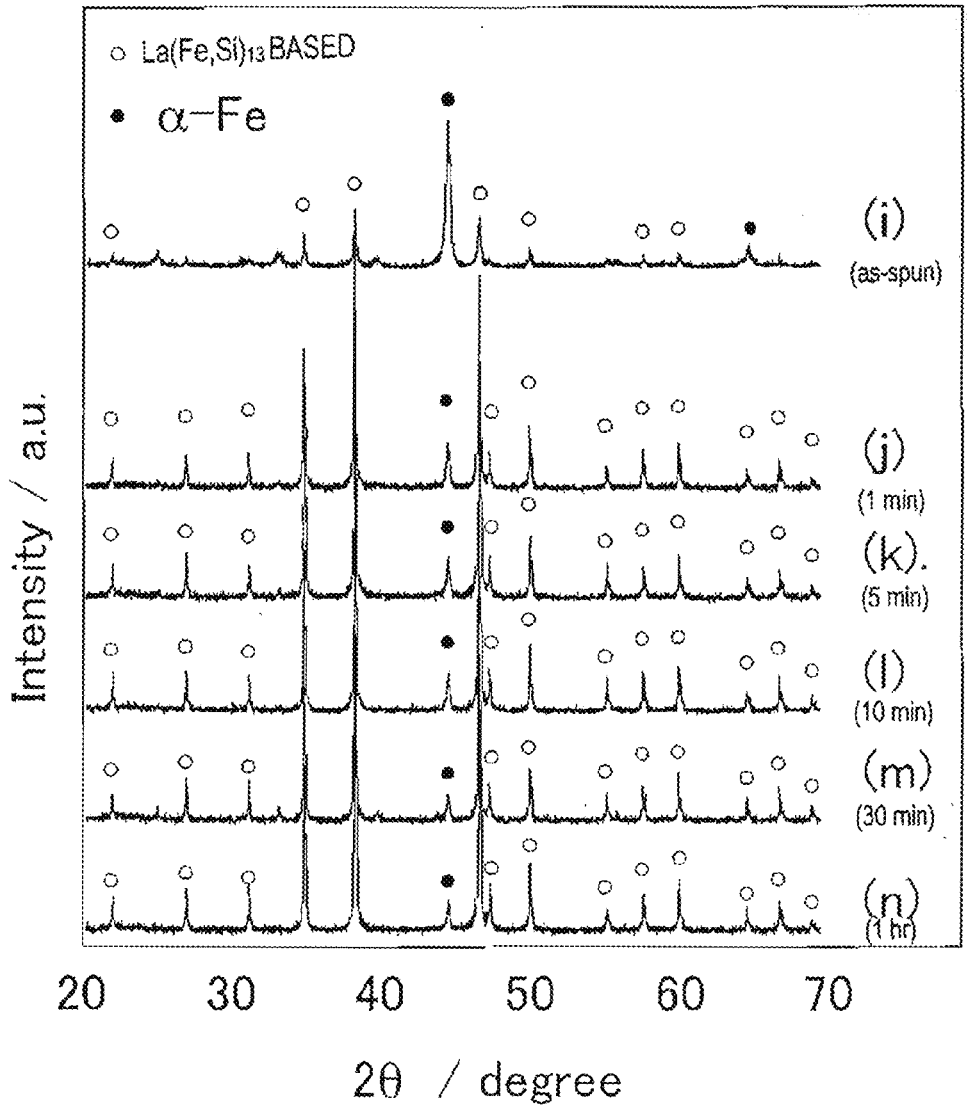
FIG. 7 is a graph showing the results of an XRD analysis that was carried out on Samples (i), (j), (k), (l), (m) and (n) made of the rapidly solidified alloys.

The respective samples were evaluated as in Experimental example No. 1 described above. FIG. 7 shows the results of an XRD analysis that was carried out to evaluate the crystal structures of Samples (i), (j), (k), (l), (m) and (n).

As is clear from the results shown in FIG. 7, by thermally treating the as-cast alloy ribbon (i.e., Sample (i)) for only one minute, the resultant Sample (j) also had a decreased α -Fe phase. Thus, it is believed that the $La(Fe, Si)_{13}$-type compound phase can still be increased effectively even by thermally treating the as-cast rapidly solidified alloy for just a short period of time (e.g., only one second).

Even if the heat treatment time was further extended, the intensities of diffraction peaks, representing the α -Fe phase, did not change until the heat treatment time reached one hour (Sample (n)). However, as already described with reference to FIG. 2, when the heat treatment time reached 24 hours (Sample (c)), the volume of the α -Fe phase rather increased. Judging from the heat treatment time dependence of the intensities of diffraction peaks representing the α -Fe phase, it is believed that the volume of the α -Fe phase did not increase until the heat treatment time reached approximately one hour. That is to say, the best heat treatment time for the rapidly solidified alloy was approximately one hour or less.

Figure 8:
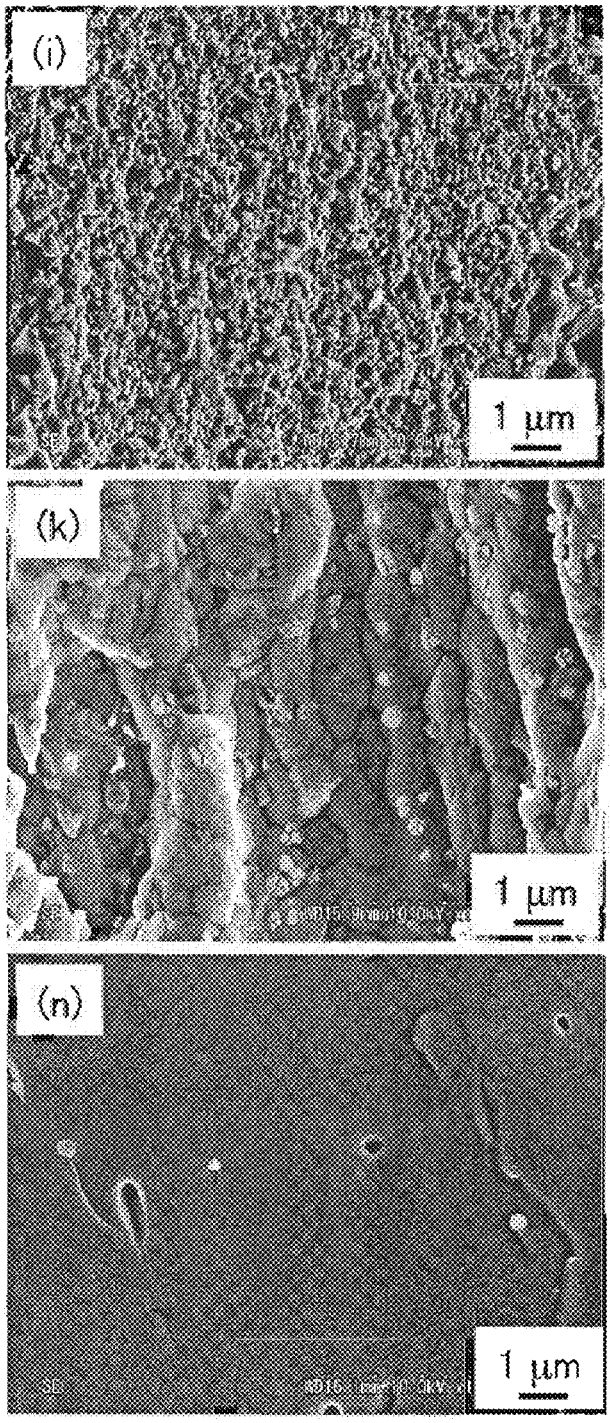
FIG. 8 is micrographs showing the fracture structures of Samples (i), (k) and (n) that had been made of rapidly solidified alloys and that were observed with an FESEM.

FIGS. 8(*a*), 8(*b*) and 8(*c*) are micrographs showing fractures of Samples (i), (k) and (n), respectively, which were observed with a field emission scanning electron microscope (FESEM).

As can be seen from FIG. 8(*a*), fine particulate structures with sizes of 1 μm or less were observed in the as-cast alloy ribbon (i.e., Sample (i)). On the other hand, Sample (k), obtained by thermally treating the as-cast alloy for 5 minutes, had structures in which particles with relatively large sizes of about 1 μm were combined together as shown in FIG. 8(*b*). When the heat treatment time was further extended to one hour, the resultant Sample (n) had no such particulate structures but a homogeneous microstructure as shown in FIG. 8(*c*).

In this manner, as the alloy ribbon is thermally treated, the alloy loses the α -Fe phase, gains the $La(Fe, Si)_{13}$-type compound phase, and has its structure homogenized.

FIG. 9 shows the magnetic properties (or magnetocaloric effects) that were evaluated for Samples (o), (p), (q), (r) and (s) obtained by the melt-quenching process and for Samples (t), (u), (v), (w) and (x) obtained by the casting process.

Comparing the temperature dependence of the magnetic entropy change $-\Delta S_{mag}$ of each sample obtained by the melt-quenching process with that of the magnetic entropy change $-\Delta S_{mag}$ of its associated sample obtained by the casting process, it can be seen that the temperature dependences were substantially equal to each other. Specifically, when the temperature was 205 K or less, the maximum $-\Delta S_{mag}$ values of both samples were in the range of 15 $Jkg^{-1} K^{-1}$ to 21 $Jkg^{-1} K^{-1}$. However, once the temperature exceeded 205 K, the maximum $-\Delta S_{mag}$ values of both samples were 9 $Jkg^{-1} K^{-1}$ or less. That is to say, when the rapidly solidified alloy was thermally treated for just 1 hour, the magnetic entropy change $-\Delta S_{mag}$ of the resultant $La(Fe—Si)_{13}$ based magnetic alloy material depended on the heat treatment temperature as much as a magnetic alloy obtained by thermally treating the cast alloy for 120 hours.

REFERENCE EXPERIMENTAL EXAMPLE NO. 3

[Surface Oxidation]

FIG. 10 shows the results of an XRD analysis that was carried out on the surface of as-spun ribbons, which had been made at a roller peripheral velocity $V_s$ of 20 m/s and then thermally treated ay 1,050° C. (=1,323 K) for 30 minutes, one hour and two hours, respectively. On the surface of the ribbons, the longer the heat treatment process time, the lower the peak intensities of the $La(Fe, Si)_{13}$-type compound phase and the higher the peak intensities of the α -Fe phase. This should be because the rare-earth element around the surface produced an oxide and dissociated during the heat treatment process.

Taking these results into consideration, it was discovered that the homogenizing heat treatment process time could be shortened significantly by adopting a melt-quenching process. Meanwhile, it also came to light that as the heat treatment process lingered on, the surface of the ribbons was more and more likely oxidized too much to maintain good magnetic properties.

REFERENCE EXPERIMENTAL EXAMPLE NO. 4

[Correlation Between Heat Treatment Process Time and Magnetic Entropy Change $-\Delta S_{mag}$]

To produce an $La(Fe, Si)_{13}$-type compound phase in the sintering process step of a powder metallurgical process, the best heat treatment process time should be selected with the homogeneity of the composition and structure and the surface state of the ribbons into consideration. Thus, the present inventors analyzed the correlation between the structural homogeneity and the magnetic entropy change $-\Delta S_{mag}$.

FIG. 11 shows $-\Delta S_{mag}$ of as-spun ribbons, which had been made at a roller peripheral velocity $V_s$ of 20 m/s and then thermally treated at 1,050° C. (=1,323 K) for 5 minutes, 10 minutes, 30 minutes, 1 hour and 24 hours, respectively. For the purpose of comparison, $-\Delta S_{mag}$ of a bulk sample (i.e., a sample that was prepared by a casting process) is also shown in FIG. 11. As to the bulk sample, the cast alloy had been thermally treated at 1,050° C. for 120 hours and then had its surface layer removed, thereby obtaining a sample for $-\Delta S_{mag}$ evaluation. The ribbons were used as samples as they were after having been thermally treated, irrespective of the surface states thereof.

Comparing the bulk sample to all of those ribbons, it can be seen that the peaks of $-\Delta S_{mag}$ of the ribbons appeared at higher temperatures and had lower heights. In $La(Fe_{1-x}Si_x)_{13}$, if x exceeds 0.12, $-\Delta S_{mag}$ decreases as shown in FIG. 9. Accordingly, it is highly probable that the overall low $-\Delta S_{mag}$ of the ribbon samples were caused by non-uniformity in composition within the ribbons generated during the sample preparation process.

Looking at $-\Delta S_{mag}$ of each of those ribbon samples, it can be seen that the peak temperature, representing the maximum value, shifted toward a high-temperature range of this graph in the interval between the 5-minute point and the 30-minute point. If the heat treatment process was carried out for 30 minutes or more, then the $-\Delta S_{mag}$ curves rose similarly to each other but showed gradually decreasing peak heights. The highest peak of $-\Delta S_{mag}$ of 10.2 $Jkg^{-1}K^{-1}$ was obtained by conducting the heat treatment process for 30 minutes. The change in peak position was highly probably caused by the difference in Curie temperature $T_c$ (i.e., the difference in the amount of Si included in the $La(Fe, Si)_{13}$-type compound phase in the ribbon sample). Meanwhile, the change in peak height should have been caused mostly by the characteristic distribution in the ribbon (i.e., the uniformity of element distribution) and the decrease in the volume of the $La(Fe, Si)_{13}$-type compound phase due to the oxidation of the ribbon surface layer.

These results revealed that $-\Delta S_{mag}$ was also affected by the structural homogeneity inside each sample. Also, the decrease in the volume of the $La(Fe, Si)_{13}$ based compound phase should have played a major part after the 30-minute point.

REFERENCE EXPERIMENTAL EXAMPLE NO. 5

[Correlation between Roller Peripheral Velocity $V_s$ and Magnetic Entropy Change $-\Delta S_{mag}$]

In a melt spinning process, the roller peripheral velocity $V_s$ has an influence on the thickness of the ribbon. $V_s$ also changes the melt quenching rate and has a significant effect on the crystal grain size of the as-spun alloy and on the sintering process time or subsequent heat treatment process time to be conducted to get the target phase. Thus, the present inventors researched how the roller peripheral velocity $V_s$ influenced $-\Delta S_{mag}$. FIG. 12 shows $-\Delta S_{mag}$ of ribbon samples that were made at roller peripheral velocities $V_s$ of 5 m/s, 10 m/s and 20 m/s, respectively, so as to realize a target composition $La(Fe_{0.88}Si_{0.12})_{13}$. The heat treatment process was conducted at 1,050° C. for 30 minutes and one hour. Compared to the $-\Delta S_{mag}$ value of 18.8 $Jkg^{-1}K^{-1}$ of the bulk sample, the $-\Delta S_{mag}$ values decreased overall, which should also been affected by the variation in the amount of Si, also. The highest $-\Delta S_{mag}$ value of 14.2 $Jkg^{-1}K^{-1}$ was achieved by the sample that was made under the conditions including $V_s$=10 m/s, 1,050° C. and 30 minutes. At any $V_s$, $-\Delta S_{mag}$ decreased after the heat treatment process was performed for one hour.

The higher the roller peripheral velocity $V_s$, the thinner the ribbon becomes and the greater the surface area of the sample becomes. As a result, deterioration in properties becomes more significant during the heat treatment process. However, since the quenching rate increases, the as-spun alloy has a smaller crystal grain size and gets homogenized more easily. Among the various conditions that were tentatively adopted this time, $V_s$ of 10 m/s was believed to be the best condition in terms of the ribbon thickness and crystal grain size.

In short, to make a rapidly solidified alloy ribbon with a high $-\Delta S_{mag}$ by a powder metallurgical process effectively, a sample should be prepared with no variation caused in composition and the best combination of roller peripheral velocity $V_s$, heat treatment temperature and heat treatment process time should be made according to the alloy composition. Also, the observation of the first order magnetic phase transition is heavily affected by the non-uniformity of the composition and the presence of hetero phases. That is why even if the compound composition remains substantially the same, the best conditions are changeable due to a slight variation in composition or the presence of impurities. For example, when a sample was made all over again from the melting process step with the target composition set on $La(Fe_{0.88}Si_{0.12})_{13}$ and subjected to the same experiment as in FIG. 12, the best heat treatment process time was one hour.

REFERENCE EXPERIMENTAL EXAMPLE NO. 6

[Oxygen Concentration]

Rapidly solidified alloys were made by a melt spinning process with the roller peripheral velocity changed. FIG. 13 shows how the oxygen concentration of an as-spun rapidly solidified alloy (of which the data are plotted with open triangles Δ) and the concentration of oxygen in a magnetic alloy, including the target phase and obtained by thermally treating the as-spun alloy (of which the data are plotted with open squares □), changed with the roller peripheral velocity. Meanwhile, FIG. 14 shows the magnetic entropy change of the magnetic alloy.

These results revealed that high magnetic entropy changes were achieved when the roller peripheral velocity was in the range of 3 m/s to 25 m/s. Thus, it can be seen that it is advantageous to control the oxygen concentration of the as-spun alloy within the range of 0.02 mass % to 0.05 mass % and the oxygen concentration of the thermally treated rapidly solidified alloy within the range of 0.25 mass % to 0.8 mass %.

[Other Compositions]

The effects of the present invention described above are achieved by not only the composition defined above but also by various other alloys having compositions represented the general formula mentioned above. This point will be described by way of experimental examples. The compositions, quenching conditions and heat treatment conditions of Samples Nos. (1) through (19), which were used in the experiments, are shown in the following Table 3:

TABLE 3

| | | Quenching condition | Heat treatment condition | | |
|---|---|---|---|---|---|
| Sample | Composition | Roller velocity | Temperature | Atmosphere | Process time |
| (1) | $La_{0.9}Ce_{0.1}(Fe_{0.88}Si_{0.12})_{13}$ | 10 m/s | 1,050° C. | Ar gas | 1 hr |
| (2) | $La_{0.9}Pr_{0.1}(Fe_{0.88}Si_{0.12})_{13}$ | 10 m/s | 1,050° C. | Ar gas | 1 hr |
| (3) | $La_{0.9}Nd_{0.1}(Fe_{0.88}Si_{0.12})_{13}$ | 10 m/s | 1,050° C. | Ar gas | 1 hr |
| (4) | $La_{0.9}Sm_{0.1}(Fe_{0.88}Si_{0.12})_{13}$ | 10 m/s | 1,050° C. | Ar gas | 1 hr |
| (5) | $La_{0.9}Gd_{0.1}(Fe_{0.88}Si_{0.12})_{13}$ | 10 m/s | 1,050° C. | Ar gas | 1 hr |
| (6) | $La_{0.9}Dy_{0.1}(Fe_{0.88}Si_{0.12})_{13}$ | 10 m/s | 1,050° C. | Ar gas | 1 hr |
| (7) | $La_{0.9}Tb_{0.1}(Fe_{0.88}Si_{0.12})_{13}$ | 10 m/s | 1,050° C. | Ar gas | 1 hr |
| (8) | $La_{0.9}Er_{0.1}(Fe_{0.88}Si_{0.12})_{13}$ | 10 m/s | 1,050° C. | Ar gas | 1 hr |
| (9) | $La(Fe_{0.88}Si_{0.12})_{13}$ | 10 m/s | 1,050° C. | Ar gas | 1 hr |
| (10) | $La(Fe_{0.84}Al_{0.16})_{13}$ | 10 m/s | 1,050° C. | Ar gas | 1 hr |
| (11) | $La(Fe_{0.76}Al_{0.24})_{13}$ | 10 m/s | 1,050° C. | Ar gas | 1 hr |
| (12) | $La(Fe_{0.64}Al_{0.36})_{13}$ | 10 m/s | 1,050° C. | Ar gas | 1 hr |
| (13) | $La(Fe_{0.8624}Si_{0.1176}Co_{0.02})_{13}$ | 10 m/s | 1,050° C. | Ar gas | 1 hr |
| (14) | $La(Fe_{0.8448}Si_{0.1152}Co_{0.04})_{13}$ | 10 m/s | 1,050° C. | Ar gas | 1 hr |
| (15) | $La(Fe_{0.8272}Si_{0.1128}Co_{0.06})_{13}$ | 10 m/s | 1,050° C. | Ar gas | 1 hr |
| (16) | $La(Fe_{0.88}Si_{0.12})_{13}$ | 10 m/s | 900° C. | Ar gas | 3 hrs |
| (17) | $La(Fe_{0.88}Si_{0.12})_{13}$ | 10 m/s | 1,100° C. | Ar gas | 1 s |
| (18) | $La(Fe_{0.88}Si_{0.12})_{13}$ | 10 m/s | 1,150° C. | Ar gas | 1 s |
| (19) | $La(Fe_{0.88}Si_{0.12})_{13}$ | 10 m/s | 1,200° C. | Ar gas | 1 s |

As can be seen from the XRD data shown in FIG. 15, a compound phase having the $NaZn_{13}$-type crystal structure was produced in each of the rapidly solidified alloys (Samples Nos. (1) through (8)) including a non-La RE (i.e., Ce, Pr, Nd, Sm, Gd, Dy, Tb or Er).

Also, as shown in FIGS. 16 and 17, even if 10 at % of such a non-La RE was added, the magnetization around 190 K changed in substantially the same way as an alloy including no additive RE (i.e., Sample No. (9), see FIG. 18). Similar effects would be achieved as for any of the other rare-earth elements (i.e., Pm, Eu, Gd, Ho and Tm).

Furthermore, as shown in FIGS. 19 and 20, a compound phase having the $NaZn_{13}$-type crystal structure was also produced, and a magnetic entropy change was also observed, even in an alloy in which 100% of "A" was Al in the general formula defined above.

Furthermore, as shown in FIGS. 21 and 22, a compound phase having the $NaZn_{13}$-type crystal structure was also produced, and a magnetic entropy change was also observed, even in an alloy including Co in the general formula defined above. Among other things, Co substitutes for Fe in the compound phase, and therefore, is advantageous in that the Curie temperature can be controlled freely to around room temperature by adjusting the amount added.

In the XRD data of Sample No. (16) shown in FIG. 23, a peak attributable to a compound phase having the $NaZn_{13}$-type crystal structure was also observed. Thus, it can be seen that the sample could be crystallized at 900° C. Meanwhile, in the XRD data of Samples (17) to (19) shown in FIG. 23, peaks attributable to a compound phase having the $NaZn_{13}$-type crystal structure were also observed. Thus, it can be seen that those sample could be crystallized even if the heat treatment process time was just one second.

Next, respective process steps to be carried out after the rapidly solidified alloy thus obtained has been pulverized and before a powder metallurgical process is started will be described.

[Rapidly Solidified Alloy Powder]

The rapidly solidified alloy (material alloy) that has been obtained in this manner is pulverized into a fine powder using a power mill, a pin mill, a hammer mill, a ball mill, an attritor, or a jet mill.

The magnetic refrigerant material to be obtained should have a thin plate shape in the end in order to make a heat exchanger type structure in which a liquid flows as a heat carrier between a lot of thin plates that are arranged parallel to each other. To increase the heat exchange efficiency, those plates need to be as thin as possible, provided that a minimum required mechanical strength is maintained. For that purpose, the smaller the powder particle size, the more effective. Nevertheless, if the powder particle size were too small, then the specific surface would increase and the oxygen concentration would rise, too. That is why the rapidly solidified alloy powder preferably has a minor-axis size of at least 2 μm. On the other hand, the minor-axis size of the rapidly solidified alloy powder has its upper limit set by the final shape as described above. When the rapidly solidified alloy is supposed to have a thickness of about 2 mm, the minor-axis size of the rapidly solidified alloy powder should be at most 200 μm. Otherwise, it would be difficult to make a compact before the sintering process. To make a sintered body with an even higher density, the minor-axis size of the rapidly solidified alloy powder is more preferably no greater than 10 μm.

[Compact]

A process of making thin-plate sintered bodies includes the basic process steps of fine pulverization, primary compaction and sintering.

The primary compaction process step of making a compact of the alloy powder that has been obtained as described above is carried out by subjecting a powder material, obtained by adding, if necessary, a lubricant to an alloy powder and mixing them together, to a press compaction process (i.e., compression compaction) using a die. Alternatively, a process of preparing a compound by mixing the alloy powder and a binder together and then molding the mixture by an injection molding technique, an MIM process, a green sheet process or any other forming process may be adopted as well. Even in a press compaction process, a binder is sometimes added to ensure a required mechanical strength for the compact. When a binder is used, a binder removal process of removing the binder from the compact is preferably carried out before the sintered process is performed. It is important to select a material, which has such a low molecular weight as to compound with La easily and which generates as little hydrocarbon gas as possible, as the binder. Among other things, to prevent a carbide from being produced as a result of a chemical reaction with La, the binder to be added is preferably removable at a low temperature. If hydrogen gas is used for the purpose of facilitating the binder removal, then the binder removal process is preferably ended at 700° C. or below and a low pressure process is preferably carried out at 700° C. and above in a vacuum furnace for the purpose of dehydrogenation.

[Sintered Body]

The conditions of the sintering process need to be appropriately defined so as to obtain a homogenous $NaZn_{13}$-type compound phase. The alloy powder of the present invention has the fine structure described above, and therefore, can contribute to generating the target phase by performing a sintering process at a relatively low temperature and in a relatively short time. For example, the target phase can be produced by performing a sintering process (heat treatment process) at 600° C. or more for at least 10 seconds. Typically, the target phase can be obtained by performing a sintering process at 900° C. or more for one hour or less. A sintering temperature higher than 1,320° C. or a sintering process time longer than eight hours is never needed. The sintering process time is preferably no longer than four hours.

By adopting a known hot-press process or an electrical discharge sintering process, the target phase can be obtained by performing a sintering process at 600° C. or more for one hour or less.

According to the present invention, an $La(Fe, Si)_{13}$ based magnetic alloy, exhibiting a magnetocaloric effect as represented by a magnetic entropy change $-\Delta S_{mag}$ of more than 5 $JK^{-1}\ kg^{-1}$ when the external field is changed from 0 T to 5 T, can be obtained as a magnetic refrigerant material by a powder metallurgical process.

Also, the regenerator and magnetic refrigerator as disclosed in Japanese Patent Application Laid-Open Publication No. 2003-028532 may be naturally made of the $La(Fe, Si)_{13}$ based magnetic alloy of this preferred embodiment.

An $La(Fe, Si)_{13}$ based magnetic alloy according to the present invention can be used particularly effectively as a magnetic refrigerant material. However, the $La(Fe, Si)_{13}$ based magnetic alloy may also be used effectively as a magnetostrictive material as disclosed in Patent Document No. 1 or 2, for example.

EXAMPLES

Hereinafter, specific methods of making an $La(Fe, Si)_{13}$ based magnetic alloy according to the present invention will be described by way of specific examples. It should be noted, however, that the present invention is in no way limited to the following specific examples.

Example No. 1

Rapidly solidified alloy ribbons having a composition $La(Fe_{0.88}Si_{0.12})_{13}$ were made by a strip casting process at peripheral velocities of 5 m/s and 15 m/s of quenching roller, respectively. The average thicknesses of the alloys were 150 μm with a standard deviation of 15 μm and 100 μm with a standard deviation of 10 μm, respectively. When their crystal structures were analyzed by the powder XRD and the SEM, the constituent phases thereof were an $NaZn_{13}$-type $La(Fe, Si)_{13}$ phase, a bcc-(Fe, Si) phase and an La-rich portion (phase) with a crystal structure which has not been identified. And the average minor-axis sizes of these phases were 1.5 μm and 1.1 μm, respectively. Each of these ribbons was coarsely pulverized with a power mill and then finely pulverized into a powder with a mean particle size of 6 μm using a jet mill in a nitrogen gas. Next, 0.05 mass % of zinc stearate and 0.1 mass % of wax were further added as a lubricant and as a binder, respectively, to the powder and mixed with the powder. The mixture was loaded into a die with dimensions of 10 mm×40 mm and pressed and compacted in the die (i.e., subjected to a powder compression process), thereby making a compact with a thickness of 2 mm. Thereafter, the resultant compact was subjected to a binder removal process at 400° C. within an Ar gas in a vacuum sintering furnace and then sintered at 1,250° C. (=1,523 K) for three hours in an Ar gas at 50 Pa. In this manner, a thin plate sintered body, of which the density was about 95% of the true density and which had dimensions of 8.4 mm×33.5 mm×1.7 mm, was obtained. 50 sintered bodies were made by this method and their reproducibility in this process was checked. And the magnetic entropy changes of the resultant sintered bodies were measured. As a result, as for the two samples that had been made at the chill roller peripheral velocities of 5 m/s and 15 m/s, respectively, the transition temperatures were 190 K and 199 K and the average $\Delta S_{mag}$ between the applied magnetic fields of 0 T and 1 T were −7 $Jkg^{-1}$ $K^{-1}$ and −9 $Jkg^{-1}$ $K^{-1}$, respectively. Consequently, it was confirmed that a magnetic refrigerant material could be made of the magnetic alloy material of the present invention by a powder metallurgical process.

Example No. 2

The present inventors analyzed what effects the differences in the alloy preparation process, composition and manufacturing process had on the sintering process. The results are as follows.

FIG. 24 shows locations of tested compositions on the ternary phase diagram of La—Fe—Si.

The manufacturing process was carried out as follows. Specifically, an as-cast alloy was made by a die casting process, pulverized, compacted and then sintered. Meanwhile, an as-spun alloy (rapidly solidified alloy ribbon), prepared by a melt spinning process (at 10 m/s), was pulverized, compacted, and sintered. And these two types of alloys were compared with each other. When the crystal structure of the as-spun alloy obtained by the melt spinning process was analyzed by the powder XRD and the SEM, the constituent phases thereof were an $NaZn_{13}$-type $La(Fe, Si)_{13}$ phase and a bcc-(Fe, Si) phase, which had average minor-axis sizes of 50 nm to 100 nm. To compare the structures of the as-cast alloy and rapidly solidified alloy ribbon, those alloys were also evaluated after having been thermally treated. The evaluations were carried out mainly by an XRD method. The compacts were pellets with a diameter ϕ of approximately 3 mm×3 mm (D: 4 $Mgm^{-3}$) and sintered with a thermal analyzer.

FIG. 26 shows the results of an XRD analysis that was carried out on rapidly solidified alloys. It can be seen that by adopting an La-rich composition in the as-spun state, the fraction of LaFeSi compound phase will increase.

FIG. 27 shows changes in the constituent phases of an as-cast alloy, which were evaluated by an XRD analysis, in a situation where the as-cast alloy was pulverized, compacted and then sintered at 1,100° C. (=1,373 K). Even when an alloy with the target composition was used, the (α -Fe, Si) phase and the LaFeSi compound phase still could not be eliminated.

On the other hand, FIG. 28 shows a situation where rapidly solidified alloy ribbons were processed in the same way. It can be seen that a substantially single-phase $La(Fe, Si)_{13}$ phase was produced. At 1,100° C. (=1,373 K), however, the sintered density was 80% or less of the true density.

FIGS. 29 and 30 shows the results of evaluation on La-rich compositions that had gone through a sintering process. In both of these two cases, an $La(Fe, Si)_{13}$ phase and an LaFeSi compound phase were identified after the sintering process. Meanwhile, the sintered density of a rapidly solidified alloy ribbon, in particular, reached about 85% of the true density even at 1,100° C. (=1,373 K). That is why an La-richer composition would be effective in increasing the density.

FIG. 31B shows how the density of a sintered body, which was obtained by sintering a compact that had been made of a rapidly solidified alloy with any of various compositions (with a density of about 4 $Mg/m^3$) for 120 minutes, changed with the sintering temperature. The alloy had a true density of 7.2 $Mg/cm^3$. The alloy compositions are shown in FIG. 31B by their respective formulae using atomic ratios. In FIG. 31B, the solid marks and solid lines show situations where rapidly solidified alloy ribbons (as-spun alloys) were used as materials, while the open marks and dashed lines show situations where as-cast alloys were used as materials. As can be seen from the results shown in FIG. 31B, denser sintered bodies were obtained from the rapidly solidified alloys than from the as-cast alloys. It can also be seen that a composition with a higher La mole fraction contributed to increasing the density more effectively.

Example No. 3

Next, it will be described in detail how to produce the target phase by the sintering process.

FIG. 32 shows backscattered electron images showing cross sections of sintered bodies that were obtained by sintering a material alloy with a composition $La_7Fe_{82}Si_{11}$ at 1,200° C. (=1473 K) for two hours. The photo on the left-hand side shows a sintered body made from a cast alloy, while the photo on the right-hand side shows a sintered body made from a rapidly solidified alloy. In FIG. 32, the black portions show vacancies, the dark gray portions show the α -Fe phase, the light gray portions show the target phase ($La(Fe, Si)_{13}$ phase) and the white portions show the LaFeSi compound phase, La—Si phase or La phase. It was observed that compared to the sintered body made from the cast alloy as shown on the left-hand side, the sintered body made from the rapidly solidified alloy as shown on the right-hand side included less α -Fe phase of a smaller size.

FIG. 33 shows an EPMA backscattered electron image (BEI) and composition images showing a cross section of a sintered body that was obtained by sintering a rapidly solidified alloy, having a composition $La_{11}Fe_{76}Si_{13}$, at 1,200° C. (=1,473 K) for two hours. In the sintered body shown in FIG. 33, it was observed that the grain boundary of the target phase was filled with at least two of the LaFeSi compound phase, a La—Si phase and a La phase, a lot of liquid phases were produced during the sintering process, and the sintered body was made denser than the sintered body structure made of the cast alloy shown on the left-hand side of FIG. 32.

FIG. 34 shows the results of an XRD analysis on a sintered body that was obtained by sintering a rapidly solidified alloy having a composition $La_9Fe_{78}Si_{13}$ for two hours at various temperatures. When the alloy was sintered at 1,270° C. (=1,543 K), almost the target phase (i.e., $La(Fe, Si)_{13}$ phase) alone was produced. However, when the alloy was sintered at a higher temperature of 1,320° C. (=1,593 K), an LaFeSi compound phase was produced against expectations, which shows that the peritectic temperature of the target phase was exceeded. Thus, it can be seen that the sintering temperature is preferably less than 1,320° C. (=1,593 K).

Example No. 4

Next, a correlation between these results and the magnetic caloric effect will be described.

FIG. 31A shows a correlation between the mole fraction of La and the magnetocaloric effect ($-\Delta S_{mag}$). A sintered body was made as in the first specific example described above except that an as-spun alloy (i.e., rapidly solidified alloy ribbon), which was obtained by a melt-spinning process (at 10 m/s) so as to have a target composition expressed by a formula $La_xFe_{bal}Si_{13}$ (where x=5 to 12 and bal represents the balance), was used as the material alloy and sintered at a temperature of 1,220° C. (=1,493 K).

As can be seen from FIG. 31A, until the La mole fraction reached about 8 at %, $-\Delta S_{mag}$ continued to increase as the La mole fraction increased. $-\Delta S_{mag}$ reached its peak at an La mole fraction of around 8 at % and then decreased after that. The reasons are believed to be as follows.

Before the La mole fraction reaches about 8 at %, the higher the La mole fraction, the less amount of α -(Fe, Si) phase is formed in the alloy, furnishing less distance for elements to diffuse during the sintering process. As a result, the sintering process can be finished in a shorter time, the alloy increases its density (see FIG. 31B) and the percentage of the $La(Fe, Si)_{13}$ phase contributing to excellent magnetocaloric effects increases, thus raising $-\Delta S_{mag}$. On the other hand, once the La mole fraction exceeds 8 at %, the percentages of non-$La(Fe, Si)_{13}$ phases (such as LaFeSi phase) increase, thus dropping $-\Delta S_{mag}$.

In view of these considerations, to increase the magnetocaloric effect, a magnetic material to be appropriately processed by a powder metallurgical process preferably has an La mole fraction of 6 at % to 11 at %, more preferably 7 at % to 9 at %.

Thus, it was discovered that by making a sintered body by a powder metallurgical process using the rapidly solidified alloy of the present invention as a material, a dense sintered body could be obtained in a relatively short time and at a relatively low temperature.

According to the present invention, an $La(Fe—Si)_{13}$ based magnetic alloy material can be obtained at a much higher productivity than the conventional process. Thus, a magnetic refrigerant material and a magnetostrictive material can be provided at significantly lower costs than the conventional process. Also, a magnetic refrigerator can also be provided at a reasonable cost. The magnetic refrigerator is environmentally friendly because no gaseous refrigerant that would cause green-house effects is used unlike a compression refrigerator. Also, by using a permanent magnet material additionally, the magnetic refrigerator achieves high energy conversion efficiency.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A method of making a magnetic alloy material, the method comprising the steps of:

preparing a melt of an alloy material having a predetermined composition; and rapidly quenching and solidifying the melt of the alloy material such that an average quenching rate is $2\times10^{4}$° C./s to $2\times10^{6}$° C./s within the temperature range of 1,500° C. to 600° C., thereby obtaining a rapidly solidified alloy in which each particle of the magnetic alloy material has a composition represented by the formula: $Fe_{100-a-b-c}RE_aA_bCo_c$, where RE is a rare-earth element that always includes La, A is either Si or Al, 6 at %≦a≦11 at %, 8 at %≦b≦18 at %, and 0 at %≦c≦9 at %, and has either a two phase structure consisting essentially of an α-Fe phase and an (RE, Fe, A) phase including 30 at % to 90 at % of RE or a three phase structure consisting essentially of the α-Fe phase, the (RE, Fe, A) phase including 30 at % to 90 at % of RE and an $RE(Fe, A)_{13}$ compound phase with an $NaZn_{13}$-type crystal structure, the respective phases having an average minor-axis size of 40 nm to 2 μm.

2. The method of claim 1, wherein the mole fraction a in the general formula is from 7 at % to 9 at %.

3. The method of claim 1, wherein the (RE, Fe, A) phase is an REFeSi compound phase.

4. A method of making a magnetic alloy material, the method comprising the steps of:

preparing a melt of an alloy material having a predetermined composition; and rapidly quenching and solidifying the melt of the alloy material such that an average quenching rate is $2\times10^{4}$° C./s to $2\times10^{6}$° C./s within the temperature range of 1,500° C. to 600° C., thereby obtaining a rapidly solidified alloy in which each particle of the magnetic alloy material has a composition represented by the formula: $Fe_{100-a-b-c}RE_aA_bCo_c$, where RE is a rare-earth element that always includes La, A is either Si or Al, 6 at %≦a≦11 at %, 8 at %≦b≦18 at %, and 0 at %≦c≦9 at %, and has either a two phase structure consisting essentially of an αFe phase and an (RE, Fe, A) phase including 30 at % to 90 at % of RE or a three phase structure consisting essentially of the α-Fe phase, the (RE, Fe, A) phase including 30 at % to 90 at % of RE and an $RE(Fe, A)_{13}$ compound phase with an $NaZn_{13}$-type crystal structure, the respective phases having an average minor-axis size of 40 nm to 2 μm, wherein Co substitutes for Fe in at least one of the α-Fe phase, the (RE, Fe, A) phase and the $RE(Fe, A)_{13}$ compound phase.

5. The method of claim 1, wherein the rapidly solidified alloy has a thickness of 2 μm to 200 μm.

6. The method of claim 1, wherein the step of obtaining the rapidly solidified alloy includes setting a teeming temperature of the alloy material higher than the liquidus temperature of the alloy material by 50° C. to 150° C.

7. The method of claim 1, wherein the step of obtaining the rapidly solidified alloy includes controlling the roller peripheral velocity of a chill roller within the range of 3 m/s to 30 m/s.

8. The method of claim 1, further comprising the step of pulverizing the rapidly solidified alloy, thereby making a powder, of which the particles have minor-axis sizes of 2 μm to 200 μm.

9. The method of claim 8, wherein particles of the powder have a minor-axis size of less than 10 μm.

10. A method of making a sintered body of a magnetic alloy, the method comprising the steps of:

making the powder by the method of claim 8;

compacting the powder to make a compact; and sintering the compact; wherein the only heat-treatment of the powder is the sintering step.

11. The method of claim 10, wherein the step of sintering includes sintering the compact within the temperature range of 600° C. to less than 1,320° C.

12. The method of claim 11, wherein the step of sintering includes sintering the compact within the temperature range for ten seconds to eight hours.

13. The method of claim 1, wherein no heat-treatment is conducted before pulverizing the rapidly solidified alloy.

14. The method of claim 4, wherein no heat-treatment is conducted before pulverizing the rapidly solidified alloy.

* * * * *